US008729437B2

(12) United States Patent
Gorman et al.

(10) Patent No.: US 8,729,437 B2
(45) Date of Patent: May 20, 2014

(54) MICROWAVE POPCORN PACKAGE, METHODS AND PRODUCT

(75) Inventors: Charles Thomas Gorman, Mahtomedi, MN (US); Paul John Warosh, Gretna, NE (US)

(73) Assignee: Con Agra Foods RDM, Inc., Omaha, NE (US)

( * ) Notice: Subject to any disclaimer, the term of this patent is extended or adjusted under 35 U.S.C. 154(b) by 1579 days.

(21) Appl. No.: 11/970,349

(22) Filed: Jan. 7, 2008

(65) Prior Publication Data

US 2008/0166457 A1 Jul. 10, 2008

Related U.S. Application Data

(60) Provisional application No. 60/879,142, filed on Jan. 8, 2007.

(51) Int. Cl.
*H05B 6/80* (2006.01)
*B65D 81/34* (2006.01)

(52) U.S. Cl.
USPC ..... 219/730; 219/725; 219/727; 426/107

(58) Field of Classification Search
USPC ..... 219/730, 727, 725; 426/107, 115, 118, 426/413, 234, 243, 625, 627; 383/104, 122
See application file for complete search history.

(56) References Cited

U.S. PATENT DOCUMENTS

| | | | |
|---|---|---|---|
| 1,331,590 | A | 2/1920 | Shotwell |
| 1,665,576 | A | 4/1928 | Witham |
| 1,707,853 | A | 4/1929 | Haberman |
| 1,765,862 | A | 6/1930 | Claff |
| 1,944,089 | A | 1/1934 | Litchfield |
| 2,030,295 | A | 2/1936 | Hodge |
| 2,041,227 | A | 5/1936 | Chalmers |
| 2,149,872 | A | 3/1939 | Schmidt |
| 2,590,580 | A | 3/1952 | Schiavone |
| 2,617,581 | A | 11/1952 | Smith |
| 2,648,479 | A | 8/1953 | Martin |
| 2,673,805 | A | 3/1954 | Colman |
| 2,673,806 | A | 3/1954 | Colman |
| 2,740,576 | A | 4/1956 | Franck |
| 2,741,559 | A | 4/1956 | Banowitz |

(Continued)

FOREIGN PATENT DOCUMENTS

| | | |
|---|---|---|
| DE | 1786047 | 11/1972 |
| DK | 81544 | 12/1956 |

(Continued)

OTHER PUBLICATIONS

U.S. Official Action mailed Dec. 6, 2011, in U.S. Appl. No. 12/559,094.

(Continued)

*Primary Examiner* — Quang Van
(74) *Attorney, Agent, or Firm* — Advent, LLP

(57) ABSTRACT

A microwave popcorn package is provided. The preferred package includes a flexible bag construction reinforced with a sidewall construction. The package is such that the flexible bag construction and the sidewall construction are selectively expandable between a collapsed configuration and an expanded configuration. After the package is opened, the sidewall construction provides for a rigid sidewall to provide a stand up bowl for access to the popped popcorn.

11 Claims, 12 Drawing Sheets

(56) References Cited

U.S. PATENT DOCUMENTS 2,815,164 A 12/1957 Painter
2,815,883 A 12/1957 Robins et al.
2,819,976 A 1/1958 Hines
2,852,898 A 9/1958 Berg
2,858,970 A 11/1958 Barnes et al.
2,865,768 A 12/1958 Barnes et al.
3,024,710 A 3/1962 Gastright
3,027,261 A 3/1962 Samara
3,035,754 A 5/1962 Meister
3,052,554 A 9/1962 Colman
3,054,680 A 9/1962 Mennen
3,107,989 A 10/1963 Fesco
3,140,034 A 7/1964 Wyman et al.
3,144,194 A 8/1964 Cartwright
3,220,635 A 11/1965 Kasting et al.
3,286,832 A 11/1966 Pilger
3,293,048 A 12/1966 Kitterman
3,326,097 A 6/1967 Lokey
3,353,327 A 11/1967 Cutler et al.
3,357,152 A 12/1967 Geigel
3,380,646 A 4/1968 Doyen et al. ..... 383/104
3,425,845 A 2/1969 Dunn
3,519,439 A 7/1970 Dunn
3,556,815 A 1/1971 Fujiwara
3,620,834 A 11/1971 Duffy
3,637,132 A 1/1972 Gray
3,638,784 A 2/1972 Bodolay et al.
3,647,508 A 3/1972 Gorrell
3,671,270 A 6/1972 Jehn
3,721,061 A 3/1973 Bodolay ..... 53/135
3,743,169 A 7/1973 Person ..... 229/31
3,777,447 A 12/1973 Herbine et al.
3,782,976 A 1/1974 Maier et al.
3,835,280 A 9/1974 Gades et al.
3,844,409 A 10/1974 Bodolay et al.
3,851,574 A 12/1974 Katz et al. ..... 426/107
3,873,735 A 3/1975 Chalin et al.
3,873,738 A 3/1975 Zoeller et al. ..... 426/111
3,956,866 A 5/1976 Lattur
3,969,535 A 7/1976 Bourns ..... 426/111
3,970,241 A 7/1976 Hanson
3,973,045 A 8/1976 Brandberg et al. ..... 426/110
4,007,285 A 2/1977 Maier et al. ..... 426/108
4,036,423 A 7/1977 Gordon
4,038,425 A 7/1977 Brandberg et al. ..... 426/107
4,043,098 A 8/1977 Putnam, Jr. et al.
4,051,993 A 10/1977 Castoldi, Jr. ..... 229/22
4,077,853 A 3/1978 Coll-Palagos
4,118,913 A 10/1978 Putnam, Jr. et al.
4,132,811 A 1/1979 Standing et al.
4,136,505 A 1/1979 Putnam, Jr. et al.
4,156,806 A 5/1979 Teich et al.
4,171,605 A 10/1979 Putnam, Jr. et al.
4,184,061 A 1/1980 Suzuki et al.
4,190,757 A 2/1980 Turpin et al.
4,196,331 A 4/1980 Leveckis et al.
4,211,360 A 7/1980 Scott et al. ..... 229/43
4,219,573 A 8/1980 Borek
4,228,945 A 10/1980 Wysocki
4,230,767 A 10/1980 Isaka et al.
4,230,924 A 10/1980 Brastad et al.
4,241,563 A 12/1980 Müller et al.
4,242,378 A 12/1980 Arai
4,258,086 A 3/1981 Beall
4,260,101 A 4/1981 Webinger ..... 229/41
4,264,668 A 4/1981 Balla
4,267,420 A 5/1981 Brastad
4,279,933 A 7/1981 Austin et al.
4,283,427 A 8/1981 Winters et al.
4,288,027 A 9/1981 Peterson ..... 229/43
4,291,520 A 9/1981 Prince et al.
4,292,332 A 9/1981 McHam ..... 426/111
4,316,070 A 2/1982 Prosise et al.
4,324,088 A 4/1982 Yamashita et al.
4,335,291 A 6/1982 Ishino et al.
4,345,133 A 8/1982 Cherney et al.
4,355,757 A 10/1982 Roccaforte
4,383,637 A 5/1983 Pfieffer et al. ..... 229/38
4,386,706 A 6/1983 Korte ..... 206/628
4,389,438 A 6/1983 Ohtsuki et al.
4,398,994 A 8/1983 Beckett
4,448,309 A 5/1984 Roccaforte et al. ..... 206/525
4,450,180 A 5/1984 Watkins
4,453,665 A 6/1984 Roccaforte et al.
4,461,031 A 7/1984 Blamer
4,477,705 A 10/1984 Danley et al. ..... 219/10.55
4,491,220 A 1/1985 Daviss ..... 206/217
4,493,685 A 1/1985 Blamer
4,496,816 A 1/1985 McNamara ..... 219/10.55
4,503,559 A 3/1985 Warnke ..... 383/40
4,509,653 A 4/1985 Corbett ..... 215/231
4,517,045 A 5/1985 Beckett
4,518,651 A 5/1985 Wolfe, Jr.
4,534,505 A 8/1985 Montealegre ..... 229/33
4,548,826 A 10/1985 Watkins ..... 426/394
4,552,614 A 11/1985 Beckett
4,553,010 A 11/1985 Bohrer et al. ..... 219/10.55
4,558,815 A 12/1985 Wischusen, III ..... 229/31
4,571,337 A 2/1986 Cage et al. ..... 426/107
4,574,956 A 3/1986 Kuchenbecker ..... 206/623
4,584,202 A 4/1986 Roccaforte ..... 426/111
4,586,649 A 5/1986 Webinger
4,596,713 A 6/1986 Burdette ..... 426/107
4,610,755 A 9/1986 Beckett
4,612,431 A 9/1986 Brown et al.
4,640,838 A 2/1987 Isakson et al.
4,641,005 A 2/1987 Seiferth
4,661,671 A 4/1987 Maroszek
4,678,882 A 7/1987 Bohrer et al. ..... 219/10.55
4,685,997 A 8/1987 Beckett
4,691,374 A 9/1987 Watkins et al.
4,701,585 A 10/1987 Stewart
4,705,707 A 11/1987 Winter ..... 428/35
4,705,927 A 11/1987 Levendusky et al.
4,713,510 A 12/1987 Quick et al.
4,724,290 A 2/1988 Campbell ..... 219/10.55
4,727,706 A 3/1988 Beer
4,734,288 A 3/1988 Engstrom et al. ..... 426/107
4,735,513 A 4/1988 Watkins et al.
4,738,287 A 4/1988 Klinkel ..... 141/114
4,738,882 A 4/1988 Rayford et al.
4,794,005 A 12/1988 Swiontek
4,797,010 A 1/1989 Coelho
4,804,582 A 2/1989 Noding et al.
4,806,371 A 2/1989 Mendenhall ..... 426/113
4,806,718 A 2/1989 Seaborne et al.
4,808,421 A 2/1989 Mendenhall et al. ..... 426/107
4,808,431 A 2/1989 Rickert ..... 427/8
4,808,780 A 2/1989 Seaborne
4,810,844 A 3/1989 Anderson ..... 219/10.55
4,810,845 A 3/1989 Seaborne
4,818,831 A 4/1989 Seaborne
4,825,025 A 4/1989 Seiferth
4,851,246 A 7/1989 Maxwell et al. ..... 426/107
4,861,958 A 8/1989 Bohrer et al. ..... 219/10.55
4,864,089 A 9/1989 Tighe et al.
4,864,090 A 9/1989 Maxwell et al. ..... 219/10.55
4,870,238 A 9/1989 Hodgetts et al. ..... 219/10.55
4,873,409 A 10/1989 Spruytenburg et al. .... 219/10.55
4,874,620 A 10/1989 Mendenhall et al. ..... 426/113
4,878,765 A 11/1989 Watkins et al.
4,883,936 A 11/1989 Maynard et al.
4,892,744 A 1/1990 Ylvisaker ..... 426/111
4,896,009 A 1/1990 Pawlowski
4,904,487 A 2/1990 LaBaw et al. ..... 426/107
4,904,488 A 2/1990 LaBaw et al.
4,914,266 A 4/1990 Parks et al.
4,915,780 A 4/1990 Beckett
4,927,648 A 5/1990 Ylvisaker ..... 426/234
4,942,050 A 7/1990 Ylvisaker ..... 426/394
4,942,277 A 7/1990 Narberes ..... 219/10.55
4,943,456 A 7/1990 Pollart et al.
4,948,932 A 8/1990 Clough
4,950,859 A 8/1990 Anderson ..... 219/10.55

(56) References Cited

U.S. PATENT DOCUMENTS 4,952,766 A 8/1990 McDonald ..... 219/10.55
4,959,231 A 9/1990 Lakey et al. ..... 426/111
4,959,516 A 9/1990 Tighe et al.
4,963,374 A 10/1990 Brandel et al. ..... 426/107
4,972,058 A 11/1990 Benson et al. ..... 219/10.55
4,973,810 A 11/1990 Brauner
4,982,064 A 1/1991 Hartman et al.
5,003,142 A 3/1991 Fuller
5,008,024 A 4/1991 Watkins
5,011,299 A 4/1991 Black, Jr. et al. ..... 383/126
5,012,068 A 4/1991 Anderson ..... 219/730
5,038,009 A 8/1991 Babbitt
5,044,777 A 9/1991 Watkins et al.
5,045,659 A 9/1991 Wolfe et al. ..... 219/10.55
5,049,072 A 9/1991 Lueschen
5,059,036 A 10/1991 Richison et al. ..... 383/61
5,061,500 A 10/1991 Mendenhall ..... 426/118
5,075,119 A 12/1991 Mendenhall ..... 426/113
5,081,330 A 1/1992 Brandberg et al.
5,095,186 A 3/1992 Scott Russell et al.
5,097,107 A 3/1992 Watkins et al.
5,153,402 A * 10/1992 Quick et al. ..... 219/730
5,171,594 A 12/1992 Babbitt ..... 426/107
5,171,950 A 12/1992 Brauner et al. ..... 219/10.55
5,174,658 A 12/1992 Cook et al. ..... 383/33
5,190,777 A 3/1993 Anderson et al. ..... 426/107
5,195,829 A 3/1993 Watkins et al. ..... 383/100
5,200,590 A 4/1993 Bowen et al. ..... 219/10.55
5,211,975 A 5/1993 Mendenhall et al. ..... 426/107
5,214,257 A 5/1993 Riskey ..... 219/10.55
5,223,288 A 6/1993 Mendenhall et al. ..... 426/107
5,284,666 A 2/1994 Graf ..... 426/242
5,294,764 A 3/1994 Mass ..... 219/727
5,294,765 A 3/1994 Archibald et al. ..... 219/727
5,298,708 A 3/1994 Babu et al.
5,302,790 A 4/1994 Turpin ..... 219/727
5,306,512 A 4/1994 Blamer ..... 426/107
5,344,661 A 9/1994 Mendenhall et al. ..... 426/107
5,357,086 A 10/1994 Turpin et al. ..... 219/732
5,388,695 A 2/1995 Gilbert ..... 206/423
5,405,663 A 4/1995 Archibald et al. ..... 428/34.3
5,419,100 A 5/1995 Gwiazdon et al. ..... 53/482
5,435,648 A 7/1995 Berkoff ..... 383/90
5,461,216 A 10/1995 McDonald ..... 219/727
5,463,848 A 11/1995 Gwiazdon et al. ..... 53/482
5,468,939 A 11/1995 MacLean, IV ..... 219/727
5,473,142 A 12/1995 Mass ..... 219/727
5,474,383 A 12/1995 Zuege et al. ..... 383/121
5,478,986 A 12/1995 Westerberg ..... 219/411
5,480,372 A 1/1996 Gwiazdon et al. ..... 493/437
5,488,220 A 1/1996 Freerks et al. ..... 219/727
5,496,252 A 3/1996 Gilbert ..... 493/224
5,498,080 A 3/1996 Dalea et al. ..... 383/120
5,507,132 A 4/1996 Gwiazdon et al. ..... 53/469
5,514,854 A 5/1996 Atsaves ..... 219/727
5,650,084 A 7/1997 Bley ..... 219/727
5,679,278 A 10/1997 Cox ..... 219/730
5,690,853 A 11/1997 Jackson et al. ..... 219/727
5,690,979 A 11/1997 Bourns et al. ..... 426/307
5,695,673 A 12/1997 Geissler ..... 219/727
5,753,895 A 5/1998 Olson et al.
5,770,839 A 6/1998 Ruebush et al. ..... 219/727
5,772,331 A 6/1998 Irace et al. ..... 383/90
5,773,801 A 6/1998 Blamer et al. ..... 219/727
5,775,570 A 7/1998 Kim ..... 229/4.5
5,780,824 A 7/1998 Matos ..... 219/727
5,814,382 A 9/1998 Yannuzzi, Jr. ..... 428/34.3
5,834,046 A 11/1998 Turpin et al.
D401,846 S 12/1998 Nguyen
5,871,790 A 2/1999 Monier et al. ..... 426/107
5,928,550 A 7/1999 Weiss ..... 219/620
5,928,554 A 7/1999 Olson et al.
5,958,482 A 9/1999 Monforton ..... 426/107
5,985,343 A 11/1999 Hasse, Jr. et al. ..... 426/394
5,993,869 A 11/1999 Freeport ..... 426/107
5,994,685 A 11/1999 Jackson et al. ..... 219/727
6,001,209 A 12/1999 Popat et al.
6,005,234 A 12/1999 Moseley et al. ..... 219/727
6,030,652 A 2/2000 Hanus ..... 426/107
6,046,443 A 4/2000 Ackerman et al. ..... 219/727
6,049,072 A 4/2000 Olson et al. ..... 219/727
6,060,095 A 5/2000 Scrimager ..... 426/107
6,060,096 A 5/2000 Hanson et al.
6,066,346 A 5/2000 Hunt et al.
6,077,551 A 6/2000 Scrimager ..... 426/107
6,100,513 A 8/2000 Jackson et al. ..... 219/727
6,126,976 A 10/2000 Hasse, Jr. et al. ..... 426/107
6,137,098 A 10/2000 Moseley et al. ..... 219/727
6,149,955 A 11/2000 Wilson ..... 426/112
6,231,903 B1 5/2001 Ji et al. ..... 426/107
6,254,907 B1 7/2001 Galomb ..... 426/115
6,259,079 B1 7/2001 Ji et al. ..... 219/727
6,320,172 B1 11/2001 Watkins ..... 219/725
D453,679 S 2/2002 Blackburn
6,350,974 B1 2/2002 Manzano et al. ..... 219/735
6,394,265 B1 5/2002 Tsao ..... 206/217
6,396,036 B1 5/2002 Hanson
6,410,065 B1 6/2002 Nottingham et al.
6,431,415 B1 8/2002 Schreiber ..... 222/460
6,586,715 B2 7/2003 Watkins ..... 219/725
6,644,540 B2 11/2003 Jamitzky et al. ..... 229/120.11
6,651,947 B1 11/2003 Price ..... 248/311.2
6,660,983 B2 12/2003 Monforton et al. ..... 219/727
D486,388 S 2/2004 Rauen
6,733,807 B2 5/2004 Martuch et al. ..... 426/107
6,752,071 B1 6/2004 Snyder ..... 99/323.5
6,872,923 B2 3/2005 Cretors et al. ..... 219/494
6,875,969 B2 4/2005 Lee ..... 219/707
6,884,978 B2 4/2005 Monforton et al. ..... 219/727
6,906,299 B2 6/2005 Watkins ..... 219/725
6,960,748 B2 11/2005 Baker ..... 219/725
7,022,359 B2 4/2006 Gibernau ..... 426/107
7,067,781 B2 6/2006 Trochlil ..... 219/730
7,086,545 B2 8/2006 Mannion et al. ..... 211/181.1
D598,784 S 8/2009 Anderson et al.
D617,654 S 6/2010 Tawinsook
D639,181 S 6/2011 Woodfield
2001/0033883 A1 10/2001 Boody ..... 426/120
2002/0043532 A1 4/2002 Watkins ..... 219/725
2002/0088730 A1 7/2002 Galomb ..... 206/459.5
2002/0100755 A1 8/2002 Peterson ..... 219/727
2002/0106427 A1 8/2002 Martuch et al. ..... 426/107
2002/0125306 A1 9/2002 Jamitzky et al. ..... 229/120.11
2002/0127306 A1 9/2002 Schmidt et al. ..... 426/107
2002/0145295 A1 10/2002 Frank et al. ..... 294/31.2
2002/0182291 A1 12/2002 Renini et al. ..... 426/107
2003/0012853 A1 1/2003 Jensen et al. ..... 426/107
2003/0044492 A1 3/2003 Knigge et al. ..... 426/124
2003/0049354 A1 3/2003 Murray
2003/0080118 A1 5/2003 Hanson ..... 219/730
2003/0106899 A1 6/2003 Langen ..... 220/912
2003/0194472 A1 10/2003 Jensen et al. ..... 426/107
2004/0013773 A1 1/2004 Duran Vila et al. ..... 426/107
2004/0031790 A1 2/2004 Kim ..... 219/727
2004/0089656 A1 5/2004 Watkins ..... 219/759
2004/0096550 A1 5/2004 Schilmoeller et al.
2004/0104222 A1 6/2004 Lee ..... 219/707
2004/0105917 A1 6/2004 Mannion et al. ..... 426/110
2004/0219332 A1 11/2004 Dean et al. ..... 428/131
2004/0238535 A1 12/2004 Mast ..... 219/730
2004/0238538 A1 12/2004 Cosentino ..... 220/23.83
2004/0245240 A1 12/2004 Cretors et al. ..... 219/494
2005/0040174 A1 2/2005 Costello et al. ..... 220/670
2005/0045624 A1 3/2005 Groll ..... 219/621
2005/0067411 A1 3/2005 Monforton et al. ..... 219/727
2005/0077291 A1 4/2005 Baker ..... 219/725
2005/0092623 A1 5/2005 Cuomo ..... 206/162
2005/0121444 A1 6/2005 Trochlil ..... 219/730
2005/0199620 A1 9/2005 Fish ..... 219/730
2005/0230459 A1 10/2005 Johnson et al. ..... 229/80
2005/0276885 A1 12/2005 Bennett
2006/0018999 A1 1/2006 Risch ..... 426/107

(56) References Cited

U.S. PATENT DOCUMENTS

| | | | | |
|---|---|---|---|---|
| 2006/0062956 | A1 | 3/2006 | Chandaria et al. | |
| 2006/0078655 | A1 | 4/2006 | Plank et al. | 426/107 |
| 2006/0127549 | A1 | 6/2006 | Murray | |
| 2006/0131303 | A1 | 6/2006 | Trochlil | 219/730 |
| 2006/0191985 | A1 | 8/2006 | Norcom | |
| 2006/0204622 | A1 | 9/2006 | Renini et al. | 426/107 |
| 2006/0231552 | A1 | 10/2006 | Caya | 219/727 |
| 2006/0261060 | A1 | 11/2006 | Baez | 220/4.21 |
| 2006/0289513 | A1 | 12/2006 | Raughley | 219/729 |
| 2006/0289524 | A1 | 12/2006 | Ludwig et al. | 219/734 |
| 2007/0284369 | A1 | 12/2007 | Murray | |
| 2008/0166457 | A1 | 7/2008 | Gorman et al. | 426/107 |
| 2008/0178744 | A1 | 7/2008 | Hill | 99/325.5 |
| 2011/0070391 | A1 | 3/2011 | Cotton | |

FOREIGN PATENT DOCUMENTS

| | | | |
|---|---|---|---|
| EP | 0 823 388 | A1 | 2/1998 |
| JP | 2005-516853 | A | 6/2005 |
| RU | 2304075 | | 4/2005 |
| WO | 2004048225 | | 6/2004 |

OTHER PUBLICATIONS

International Search Report and Written Opinion mailed Jun. 30, 2011, in Application No. PCT/US2010/048762.

European Search Report and Written Opinion mailed Apr. 29, 2010 in Application No. 08713616.4.

International Search Report and Written Opinion mailed May 22, 2008.

Accessed at http://www.emeraldnuts.com/ Easy Open Pull String, on Dec. 4, 2009; 1 pg.

U.S. Official Action mailed Apr. 23, 2012, in U.S. Appl. No. 12/559,094.

U.S. Official Action mailed Apr. 23, 2012, in U.S. Appl. No. 29/394,183.

U.S. Official Action mailed Nov. 6, 2012, in U.S. Appl. No. 12/953,123.

U.S. Official Action mailed Jun. 1, 2012, in U.S. Appl. No. 29/394,187.

U.S. Official Action mailed Jun. 26, 2012, in U.S. Appl. No. 12/953,123.

U.S. Official Action mailed Jul. 18, 2012, in U.S. Appl. No. 29/394,193.

* cited by examiner

MICROWAVE POPCORN PACKAGE, METHODS AND PRODUCT

RELATED APPLICATIONS

This application claims priority from U.S. Provisional Patent Application Ser. No. 60/879,142 filed on Jan. 8, 2007 and is hereby incorporated by reference in its entirety.

TECHNICAL FIELD

The present disclosure relates to materials and packaging for use as expandable package arrangements for popping microwave popcorn.

BACKGROUND

Many microwave popcorn popping constructions in current commercial use are multi-ply paper bags in which inner and outer flexible paper sheets are laminated to one another, typically with a microwave interactive construction (sometimes referred to as a microwave susceptor) encapsulated between the two flexible paper sheets or plies. Popcorn popping bags of this type are described, for example, in U.S. Pat. Nos. 4,904,488; 4,973,810; 4,982,064; 5,044,777; 5,081,330; 5,753,895; 5,928,554; and, 6,396,036. The complete disclosures of these eight patents are incorporated herein by reference.

A common feature of such constructions is that they are generally made from relatively flexible paper materials. Typically, when a two-ply arrangement is used, the inner ply is a greaseproof or grease-resistant paper, the preferred inner ply being a flexible paper material having a basis weight no greater than about 25 lbs. per ream, typically within the range of 20-25 lbs. per ream. In such instances, it can be a fluorochemical treated paper or other treated paper having a grease resisting characteristic. Grease resistance can be determined using a test called the Scotchban® test, which defines an acceptable level of grease resistance from industry to industry. For microwave popcorn packaging constructions, a material is considered "grease resistant" if, under the Scotchban test, it has a grease resistance of minimum kit 8. A useable material is a grease proof paper known as RHI-PEL 250, available from Rheinlander Paper Company of Rheinlander, Wis. 54501. A useable fluorochemical treatment is Ciba Lodyne 208E from Ciba Specialty Corporation North America, High Point, N.C. 27261-2444.

The outer ply is typically a 21 lb. bleached Kraft paper.

Using these common two-ply construction techniques, the resulting microwave popcorn container constructions can be provided in a bag form that is: (a) collapsed and folded when stored before use; (b) can be unfolded and expanded during a popping operation, when a popcorn charge therein is exposed to microwave energy in a microwave oven; and, (c) can be collapsed for disposal, once used. Since the materials are constructed such they can be collapsed and folded, the arrangements can be easily manufactured, filled, shipped and stored. Because the materials allow for the unfolding for use and expansion during popcorn popping, a convenient popcorn popping and dispensing container is provided.

An issue with many current commercially available microwave popcorn bag constructions, for example of the type characterized in the previously recited (eight) patents, relates to certain of the same basic features that provide advantage, i.e., the flexible, collapsible and foldable nature of the bag constructions. In particular, in many instances consumers wish to eat the popcorn from a relatively rigid walled, upright, bowl construction, as opposed to a flexible paper, foldable, expandable/collapsible construction.

A variety of alternative microwave popcorn package arrangements, utilizing rigid walled containers, in the shape of a bowl or tub, are available. Some examples are described in U.S. Pat. Nos. 5,008,024; 5,097,107; and 5,834,046. The complete disclosure of these three patents is also incorporated herein by reference.

A shortcoming of the tub configurations of the types characterized in the identified patents stems in part from some of the same features that provide advantageous operation as a tub. That is, the relatively rigid three-dimensional structure of the tub walls and bottom is inconvenient to package, ship and store.

SUMMARY

A microwave popcorn package is provided. The microwave popcorn package generally has a collapsed configuration and an expanded configuration. The collapsed configuration is the configuration of the popcorn package prior to exposure to microwave energy in a microwave oven, to pop a contained, unpopped, microwaveable popcorn charge.

The microwave popcorn package preferably comprises microwave transparent materials, except for a microwave interactive construction used as described herein. This will be preferred, for most efficient utilization of microwave energy to cause microwave popcorn popping. Alternatives are possible, but are generally not preferred.

The microwave popcorn package generally includes two structural components: (a) a sidewall construction; and, (b) a flexible bag construction. Together, the two components provide for an arrangement which: (a) contains unpopped microwaveable popcorn in a convenient container; (b) which can expand upon exposure to microwave energy as the popcorn pops; and, (c) which can be stood up and used as a rigid walled bowl, for access to the popped popcorn.

The sidewall construction provides for the rigid wall in the eventual bowl configuration. In general the walls are "vertically rigid" meaning they are resistant to collapse when stood vertically during normal use. However they are flexible and can be deformed from a flat to an expanded ring or curved configuration, as described. The sidewall construction preferably comprises a paperboard material. The sidewall construction as a result has a first collapsed configuration and a second expanded, or bowl, configuration. The typical bowl configuration is a ring.

In one preferred arrangement, the bag construction is secured to, and is positioned between panels of, the sidewall construction. Thus, the bag construction is positioned internally of, or inside, the sidewall construction. A portion of the bag construction may project outwardly from inside of the sidewall construction. This portion is preferably torn off, when the package is opened for use.

In a typical preferred arrangement, the bag construction is surrounded by, or circumscribed by, the sidewall configuration. However, alternatives are possible.

The flexible bag construction preferably comprises a microwave popcorn bag having a top and a bottom gusset. It is preferably folded from a single, or one-piece, package blank. The term "one-piece" in this context is meant to refer to a package blank that is a single unit. It may comprise various layers secured to one another.

In one typical embodiment, disclosed, the flexible bag construction has first and second side panels and bottom gusset. However alternative configurations with additional gussets or panels, are possible.

The package blank may comprise a single ply or multi-ply construction. Preferably the bag construction is positioned such that a base gusset thereof is positioned inside of the sidewall construction. The base gusset, when expanded, will form a bottom of the bowl, inside the upwardly standing sidewall construction. Thus, the bottom of the bowl is not rigid, rather it is a flexible bag material.

The bag construction, then, can be characterized as having: a first collapsed configuration in which the bottom gusset is (and, if present, a portion of the first and second side panels are) positioned folded collapsed and positioned inside the sidewall construction; and, as having a second expanded configuration in which the bottom gusset is expanded when inside of the bowl or ring configuration of the sidewall construction, to form a bowl having a vertically rigid sidewall and a flexible bottom.

In one preferred configuration, the sidewall construction comprises first and second paperboard panels. The panels can be formed from a single piece, or can be two pieces adhered to one another. Each of the panels has opposite side ends or edge portions, and each preferably includes plurality of score (or crease) lines or weakening lines extending generally parallel to the side edge portions. The score or crease lines facilitate flexing of the paperboard construction into the curved, expanded or ring configuration. Preferably each one of the first and second paperboard panels is rectangular, although alternate shapes can be used.

The score or crease lines in each panel are preferably vertically complete and continuous, as characterized herein.

Preferably the bag construction includes a removable top portion which extends outwardly from between the panels of the sidewall construction, in a direction opposite from the base or bottom gusset. The top portion is preferably configured to vent during a popping operation, and also to be removed from (or be torn from) the remainder of the package, after the popcorn is popped.

The bag construction preferably includes a central portion in which unpopped popcorn is positioned, prior to popping. Preferably the construction includes a microwave interactive construction positioned in thermoconductive relation to the central portion, so the heat from the microwave interactive construction is transferred to the vicinity of the unpopped popcorn, during a microwave popping operation.

Preferred adhesive patterns for the bag blank and also for adhering the bag construction to the sidewall construction are provided. A particular, unique, adhesive pattern between the sidewall construction and the bag construction facilitates expansion of the bag and standing up of the bowl, after popping.

According to the present disclosure, methods of providing such an expandable bowl construction are also provided.

DRAWINGS

DETAILED DESCRIPTION

In the figures, some relative material thicknesses and component sizes may be shown exaggerated, to facilitate an understanding of the invention.

The disclosure concerns a microwave popcorn package which has a first collapsed configuration and a second expanded configuration. In general, the package has the collapsed configuration, prior to the being exposed to microwave energy in a microwave oven, to pop internally received popcorn. After the popcorn is popped, the package adopts an expanded configuration. After manipulation, the package can be stood up, with a top open, forming a bowl with top access to internally received, popped, popcorn.

Herein the terms "top" and "bottom" are used to refer to components, with reference to relative location after the package is configured in an expanded configuration and is stood up, for normal use. Thus, the terms "top" and "bottom" may be used to identify components even when those components are in the collapsed configuration, but with reference to eventual relative locations once the package is expanded and positioned stood on its bottom or base, for normal use.

I. General Features of the Overall Package

Figure 1:
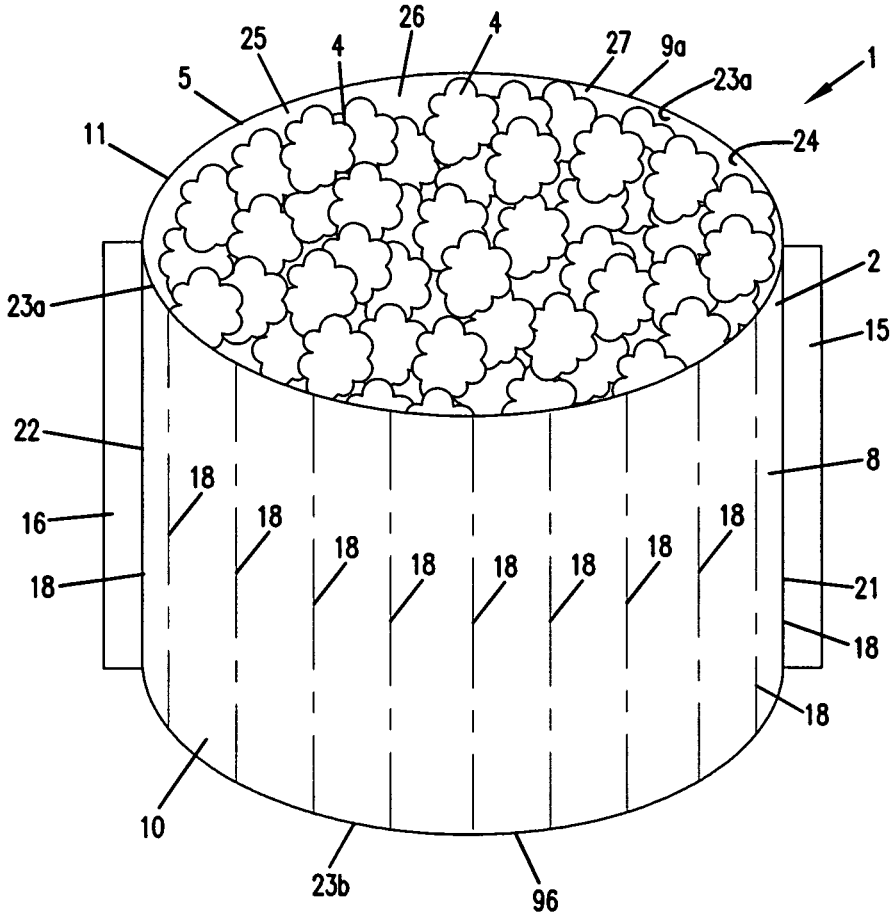
FIG. 1 is a schematic, perspective view of a microwave popcorn package according to the present disclosure, after a step of popcorn popping in a microwave oven and after a step of package opening.

The reference numeral 1, in FIG. 1, depicts a microwave popcorn package according to the present disclosure after steps of: (a) popping microwave poppable popcorn upon exposure of microwave energy in a microwave oven to convert the microwave popcorn package from a collapsed configuration to an expanded configuration; and, (b) opening of the package 1 and positioning for normal use for access to popped popcorn therein. In FIG. 1 is depicted a portion of package 1, which includes an open or expanded package bowl 2 that remains to be stood upright, for normal use, after a top portion is torn off to open the package 1 to provide access to popped popcorn 4 through open top 5.

The package 1 generally includes a sidewall construction 8. In general, sidewall construction 8 is vertically rigid. By the term "vertically rigid" and variants thereof, in this context, it is meant that the sidewall construction 8 is resistant to collapse when stood up in the orientation shown in FIG. 1, in the vertical direction. The term "vertically rigid" is not meant to suggest it cannot be collapsed, but rather it is resistant to collapse under ordinary use conditions, and is more resistant to collapse than a flexible paper bag portion (alone) of the construction.

The preferred sidewall construction 8 depicted defines the bowl 2 having an upper or top edge 9*a* and lower or bottom edge 9*b*, and includes first and second panels 10, 11 extending between side ends 15, 16. For the particular sidewall construction 8 shown, each of the first and second panels 10 and 11 comprises a vertically rigid material such as a paperboard or fiberboard construction adapted to be curved or configured from a flat or collapsed configuration into an expanded or ring configuration to define the open top 5 depicted. The paperboard of first panel 10 is modified by creases or scores 18 to allow for, and to facilitate, curvature. The second panel 11 preferably includes analogous creases or scores, not shown. The creases or scores 18 extend across the sidewall construction 8, and help the first and second panels 10, 11 to be flexed into a curved configuration analogous to the one shown. Creases or scores 21, 22 adjacent side ends 15, 16, respectively, facilitate flexing of first panel 10 at this location. The second panel 11 preferably would include analogous creases or scores to creases or scores 21, 22.

In general terms, the sidewall construction 8 can be viewed as having top edge 9*a*, bottom edge 9*b*, and side ends 15, 16. The creases or scores 18 can generally be viewed as vertical scores or creases, since they extend vertically when the sidewall construction 8 is in its expanded, upright, position as shown in FIG. 1. Herein if the creases or score lines extend completely between the top edge 9*a* and the bottom edge 9*b*, they will be characterized as "vertically complete." When the creases or score lines are continuous, and not segmented, they will be characterized as "continuous" or by variants thereof. In general terms, the preferred creases or score lines can be said to extend generally parallel to the side ends 15, 16.

The creases or scores 18, 21, 22 are preferably not cuts through or part-way through the first and second panels 10, 11, although such is possible. Rather, the creases or scores 18, 21, 22 are preferably package creases or scores of the type used on paperboard packaging containers, to create separate panels and tabs. Such creases or scores are generally formed by creaser equipment that compresses the paperboard material along a defined line creating a region of weakness that can be easily folded or manipulated. Thus, the creases or scores 18, 21, 22, can be formed with standard packaging equipment for paperboard or cardboard containers.

The first and second panels 10, 11, can comprise separate pieces of paperboard or fiberboard secured to one another; or, they can be folded from a single piece of paperboard or fiberboard. Herein the term "paperboard" is meant to include various forms of fiber board and cardboard provided they are sufficiently vertically rigid to resist vertical collapse under conditions of normal use, when positioned as shown in FIG. 1.

A typical paperboard material usable will be paperboard material of at least 8 points, usually within the range of 8-15 points, and preferably 10-12 pts. In the paperboard industry, typically 1 point is equal to 0.001 inch or 0.025 mm.

Paperboard materials useable include those having a weight of at least 75 lbs. per ream, typically and preferably at least 85 lbs. per ream, for example 90 lbs./ream or more. By this it is not meant that other materials cannot be used, it is simply meant that these are useable.

FIG. 1 is schematic. The amount of curvature obtained in the first and second panels 10, 11 due to the presence of the creases or scores 18, 21, 22 will depend upon such factors as: the number of and spacing of the creases or scores; the thickness of the first and second panels 10, 11; the length of the first and second panels 10, 11 between the side ends 15, 16; and the extent to which the package is manipulated into the curved construction by the consumer.

In the embodiment shown, the first and second panels 10 and 11 are identical to one another, positioned as mirror images in the package 1. Each defines an upper or top edge 23*a* and an opposite lower or bottom edge 23*b*, corresponding to top and bottom edges 9*a*, 9*b*, respectively.

Again, preferably the first and second panels 10, 11 each comprise a fiberboard or paperboard such as a 10 to 12 point cardboard or paperboard. This allows the panels 10, 11 to have substantial vertical rigidity in the direction from top edge 23*a* to bottom edge 23*b*. Thus, the sidewall construction 8 will operate as, and define, a sidewall of a bowl configuration 2, when stood up as shown in FIG. 1.

The creases or score lines 18, 21, 22 provide for weakness in portions or segments of the first and second panels 10, 11, to allow easy adaptation from flat (non-expanded) to the curved (ring or expanded) form depicted in FIG. 1. The creases or score lines 18, 21, 22 may be continuous or discontinuous (segmented), but continuous lines from the top edge 23*a* to the bottom edge 23*b* will typically be preferred. The number of creases or score lines between side ends 15, 16 is a matter of choice, depending upon the amount of curvature desired. Score lines or creases between opposite edges 23*a*, 23*b* spaced approximately every 15 to 35 mm, preferably every 19 to 30 mm, are currently preferred.

In general, for package 1, the sidewall construction 8 defines an interior 24 occupied by a flexible bag construction 25. The flexible bag construction 25 preferably comprises of flexible paper construction 26 as described below. The popped popcorn 4 is contained within an interior 27 of the flexible bag construction 25.

In general, the flexible bag construction 25 provides an enclosure for the microwave poppable popcorn charge during storage of package 1 and popping; and, a bottom for the resulting bowl arrangement. Thus, the flexible bag construction 25 has an expanded configuration and a collapsed configuration. The flexible bag construction 25 occupies a collapsed configuration prior to popping, and the expanded configuration after popping. The flexible bag construction 25 can be pre-made and then be positioned, for example, inside sidewall construction 8, i.e., between first and second panels 10, 11, to form the package 1.

Figure 2:
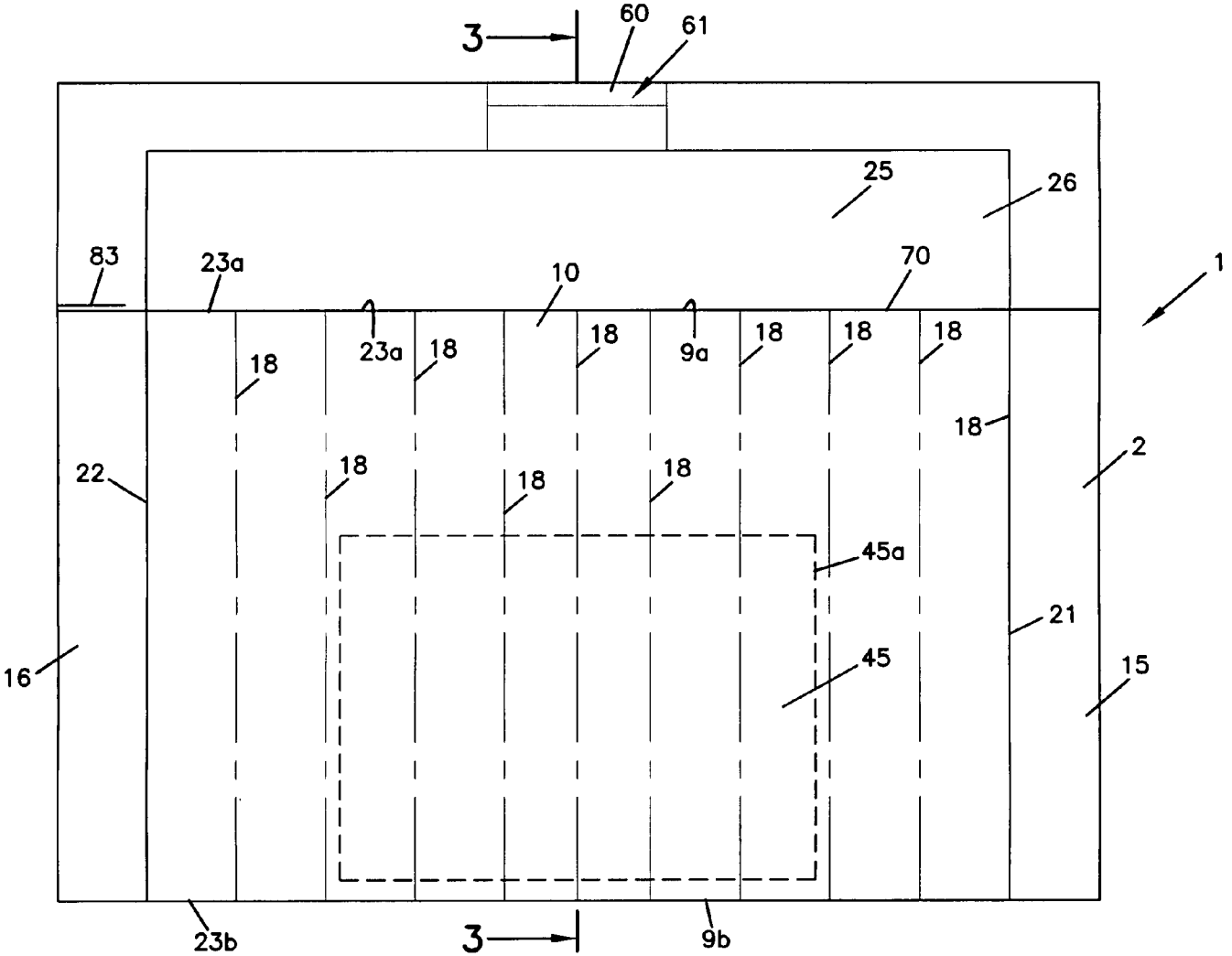
FIG. 2 is a schematic, plan view of the microwave popcorn package according to the present disclosure, prior to a step of microwave popcorn popping.
Figure 3:
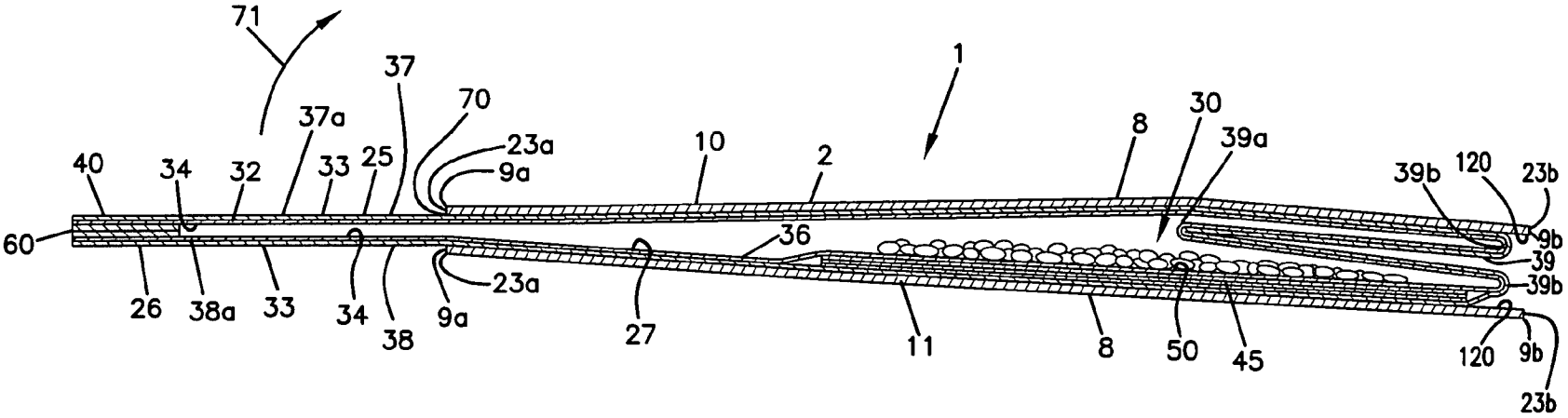
FIG. 3 is a cross-sectional view of the package arrangement shown in FIG. 2, taken generally along line 3-3 thereof.

In FIGS. 2 and 3, the package 1 is depicted in a collapsed form; i.e., as it would appear before a popping operation, for example, after the package 1 has been placed on the floor of a microwave oven for a popping operation, and before a portion has been removed to open the package 1. Referring to FIG. 3, the sidewall construction 8 is viewable in the collapsed form comprising first and second panels 10, 11 defining top and bottom edges 23*a* and 23*b* respectively. The internal flexible bag construction 25 is viewable in a collapsed form and defining interior 27 in which an unpopped popcorn charge 30 is positioned. The unpopped popcorn charge 30 may include various components or additives such as fat/oil, salt, seasonings, nutrients, etc., as are commonly used for microwave popcorn products.

With the present invention, various components used as part of the charge 30, for example a fat, oil or other components, can be included within an internal pouch structure, for example the type described in U.S. patent application having Ser. No. 10/299,537, incorporated herein by reference.

Referring to FIG. 3, although a variety of alternatives are possible, the flexible bag construction 25 for the embodiment shown comprises a two-ply bag arrangement 32 having an outer-ply 33 and an inner ply 34. The flexible bag construction 25 is preferably folded from a single or one-piece panel blank 36, shown in FIGS. 7 and 8, to define first and second opposite sides 37 and 38, with a base or bottom gusset 39 positioned therebetween. The bottom gusset 39 is "inwardly directed." By this, it is meant that a center fold line 39*a* of the gusset 39 is directed inwardly between sides 37, 38, from edges 39*b*.

A portion of side 37 is secured to the first panel 10 with an end portion 37*a* of side 37 projecting outwardly from between the first and second panels 10, 11 beyond the top edge 9*a*. By use of the term "beyond" in this context, it is meant that the extension is out from between the first and second panels 10, 11 in a direction from edge 9*a*. Similarly, side 38 is secured to second panel 11 with a portion 38*a* projecting outwardly from between the first and second panels 10, 11 beyond the top edge 9*a*.

Extension 40 of the flexible bag construction 25, which comprises the portions 37*a*, 38*a* extending outwardly from between the first and second panels 10, 11, beyond the top edges 9*a*, is configured to be torn from a remainder 2 of the package 1 during an opening step, as discussed below.

Still referring to FIG. 3, microwave interactive construction or susceptor 45 is shown positioned in thermoconductive relation to a central region 50 of the second panel 11. In FIG. 2, phantom lines 45*a* indicate the approximate position of microwave interactive construction 45. For the particular embodiment depicted, the microwave interactive construction 45 is positioned between the plies 33, 34.

Herein the term "microwave interactive construction" is meant to refer to a construction which, upon exposure to microwave energy in a microwave oven, generates heat. A variety of microwave interactive constructions are known, typical ones comprising a metalized (such as aluminized) polyester film.

The unpopped popcorn charge 30 is shown positioned within interior 27 of the flexible bag construction 25 in the central region 50, over, and in thermoconductive contact with, microwave interactive construction 45. When the arrangement of FIG. 3 is placed in a microwave oven in the general orientation shown in FIG. 3, and is exposed to an adequate level of microwave energy, heat and generated steam or vapor will cause expansion of the flexible bag construction 25 and thus the package construction 1. Eventually, the flexible bag construction 25 will vent along top seam 60. Typically top seam 60 is constructed to have at least a central portion 61 (FIG. 2) thereof comprise a heat releasable material, to allow and facilitate venting. In addition, the flexible bag construction 25 will expand, pushing the first and second panels 10, 11 away from one another and opening base gusset 39.

The appropriate orientation for the package 1, when placed in a microwave oven for popping, as shown in FIG. 3, is generally with: the second panel 11 adjacent to microwave interactive construction 45, positioned down; and, with the unpopped popcorn kernels positioned above the microwave interactive construction 45. In this manner, the heat generated at the microwave interactor construction 45 is underneath the popcorn.

Each of the first and second panels 10, 11 for a microwave package of the type depicted in FIGS. 1-3, can be manufactured from paperboard, typically to provide outer dimensions of at least 20 cm., typically 20-40 cm. long (wide) by at least 10 cm., typically 10 to 22 cm. high to contain 25 to 80 g. unpopped popcorn kernels, when collapsed. Referring to FIG. 2, if region 40 is folded over the first panel 10, the entire collapsed construction can be packaged, for storage, within a peripheral perimeter area only slightly larger than the perimeter area of the first and second panels 10, 11 themselves. This means that the arrangement 1, prior to popping operation, can be conveniently stored within a moisture barrier outer package or wrap, such as a polyethylene or oriented polypropylene wrap, for storage, shipment and display. In addition, the surfaces of the paperboard first and second panels 10, 11, as well as the flexible bag construction 25 in region 40, can be used for printing to display graphics or information.

Still referring to FIGS. 2 and 3, it is again noted that when the package construction 1 is stored within a moisture barrier overwrap, not shown, typically region or extension 40 would be folded over the first panel 10, for example, along a fold line indicated generally at 70, FIG. 2. Thus, typically the package 1, when opened for use after typical storage, would not lay as flat as depicted in FIGS. 2 and 3 schematically, but rather as a result of having been folded during storage, region 40 would tend to bend upwardly somewhat, in the direction of arrow 71, FIG. 3.

Of course, the folding around fold line 70 could have been in the opposite direction, i.e., over the second panel 11. However, it will be most convenient if the folding is over the first panel 10 that does not have the susceptor 45 immediately adjacent, to allow the second panel 11 near the susceptor 45 to lay relatively flat on a microwave oven floor or internal rack or table, during a microwave popping operation.

Figure 4:
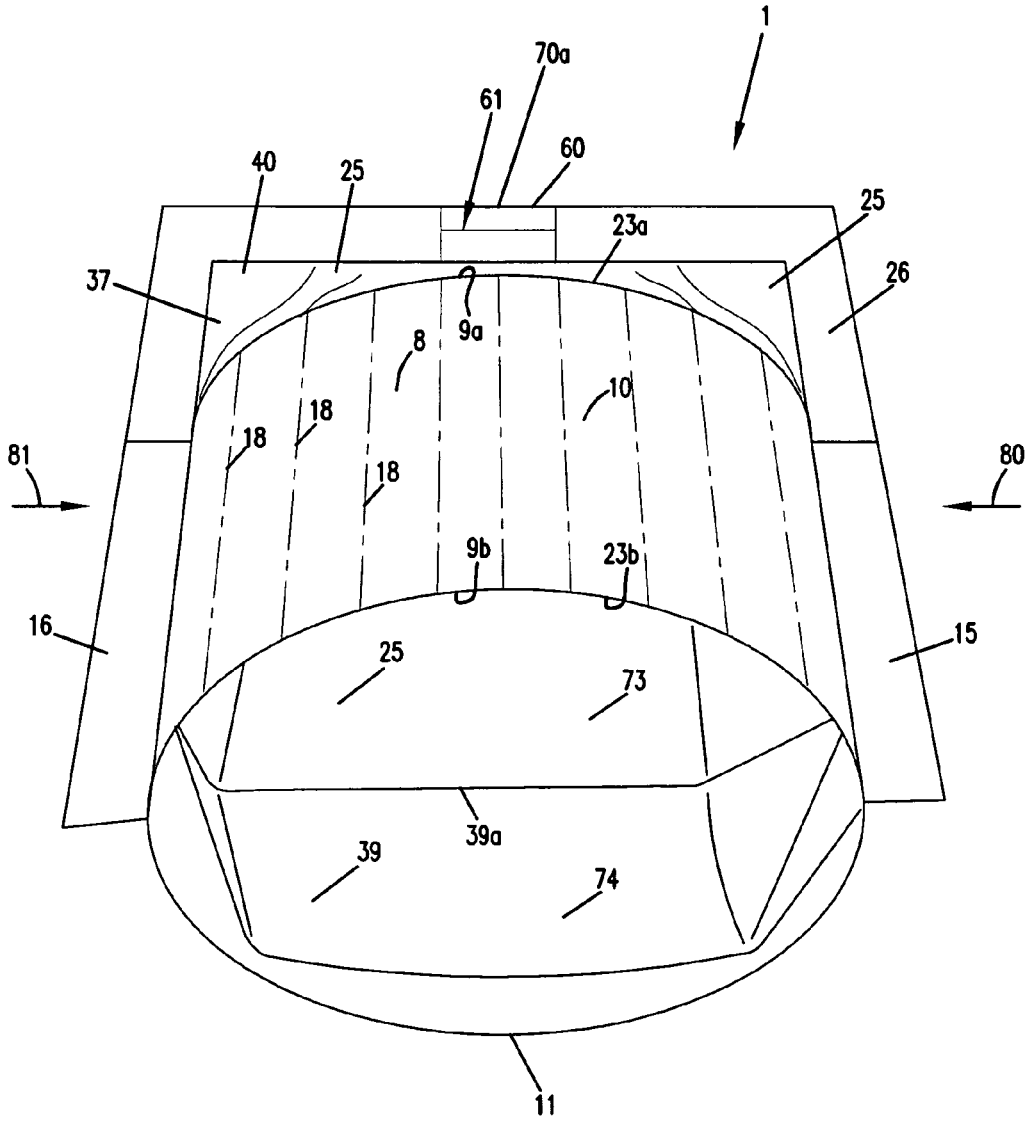
FIG. 4 is a schematic, perspective view of the package arrangement of FIGS. 2 and 3; depicted after a step of microwave popcorn popping but while the package arrangement is lying on a side, as it would during and immediately after popping.

Attention is now directed to FIG. 4, in which the package 1 is depicted in an expanded, vented, orientation after a step of microwave popping, and before a step of tearing region or extension 40 from a remainder 2 of the package 1, in order to open the package 1. Referring to FIG. 4, the first and second panels 10, 11 are shown expanded apart, but secured together at side ends 15, 16. Region 40 would be vented at vent 70*a*. The flexible bag construction 25 is shown positioned between the first and second panels 10, 11 with base gusset 39 expanded open along opposite panels 73, 74. The crease or score lines 18 facilitate curving of the first and second panels 10, 11 into the configuration shown. Further facilitation of curving of the first and second panels 10, 11 can be caused by the consumer, upon grasping and pressing side ends 15, 16 toward one another, i.e., in the directions indicated generally at arrows 80, 81 respectively.

Figure 5:
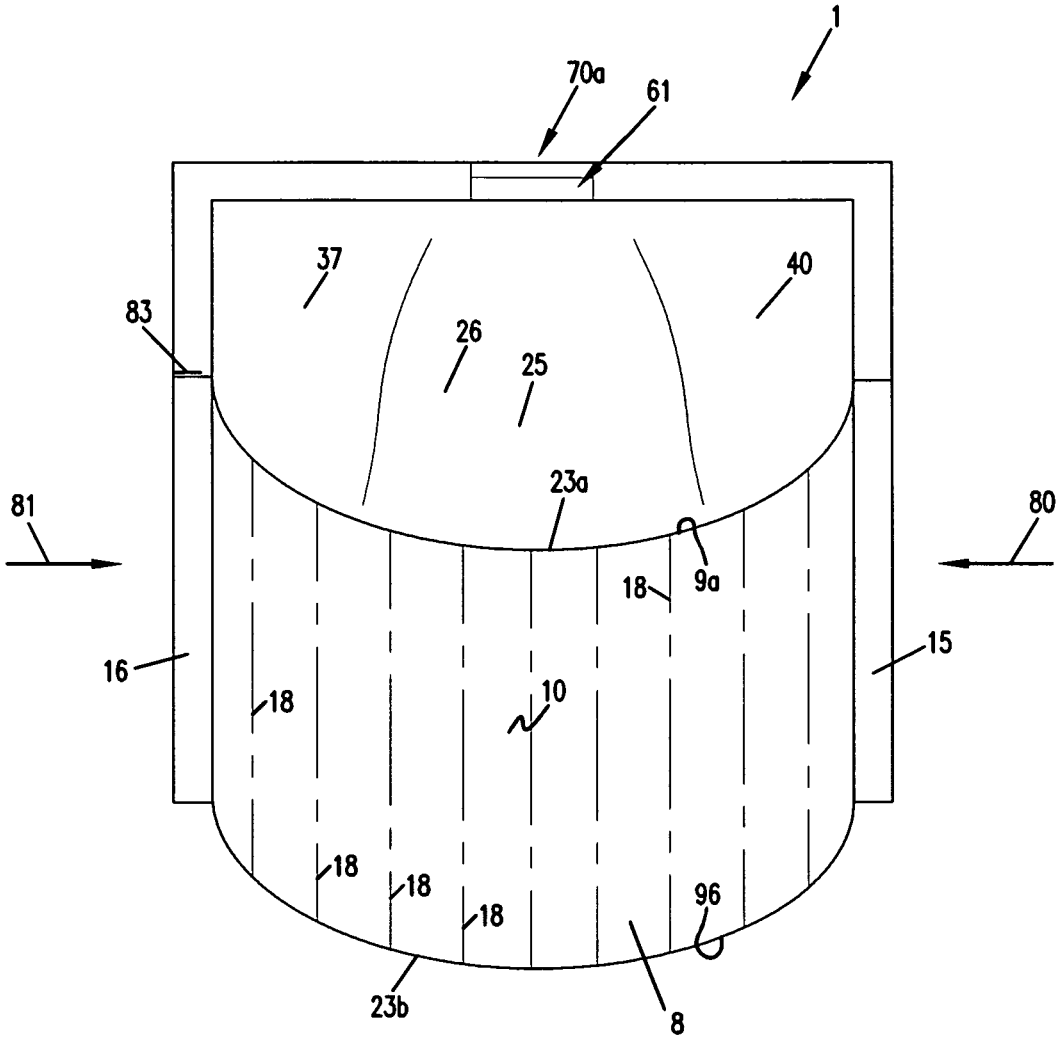
FIG. 5 is a depiction of the microwave popcorn package of FIG. 4, after a step of microwave popcorn popping, but shown stood up on its base.

Attention is now directed to FIG. 5, in which the vented, expanded, package 1 of FIG. 4 is depicted standing upright. During this step of standing, it may be convenient for the consumer to apply pressure against the side ends 15, 16 in the direction of arrows 80, 81 to facilitate formation of the package into the curved arrangement shown. Also, the consumer may shake the package 1 or tap it against a counter surface, to facilitate settling the popcorn before opening. In FIG. 5, a tear line or cut in the flexible bag construction 25 to facilitate opening is shown at 83.

Figure 5A:
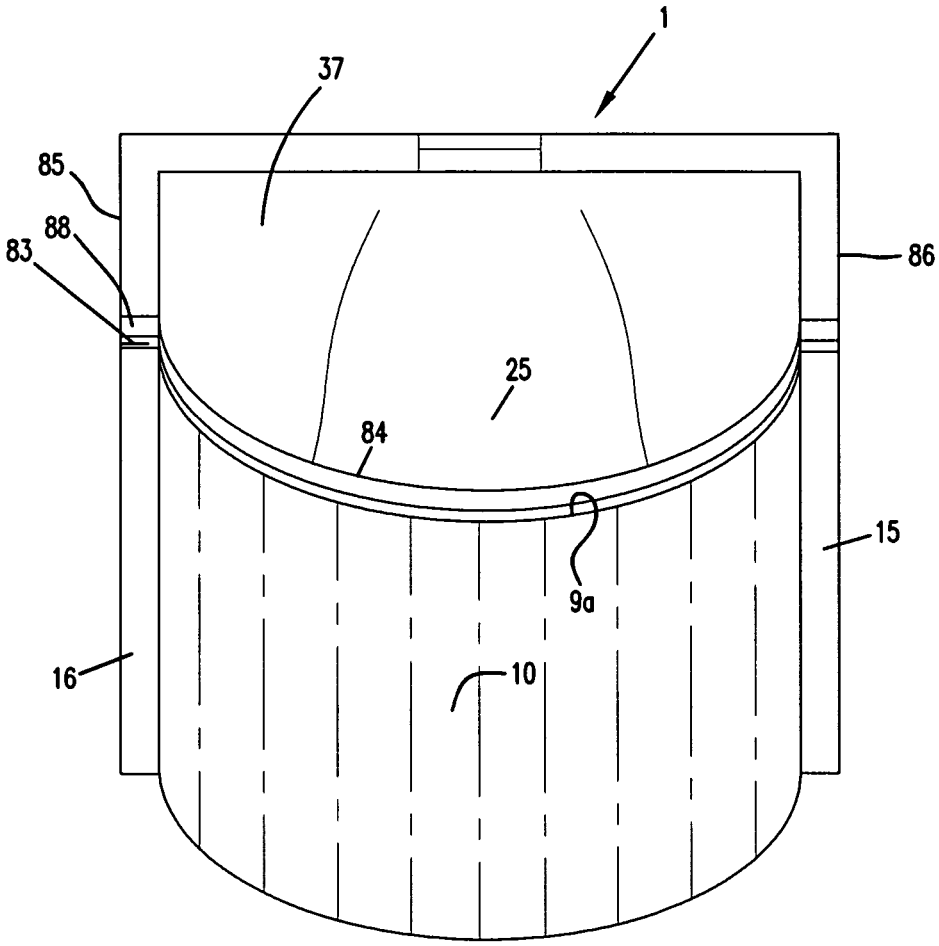
FIG. 5A is an alternate depiction of a microwave popcorn package after a step of microwave popcorn popping, but shown stood up on its base.

In FIG. 5A, the flexible bag construction 25 of the package 1 includes a tear strip 84. In one embodiment, the tear strip 84 is disposed on an exterior surface of the first and second opposite sides 37, 38 (shown in FIG. 3) of the flexible bag construction 25. In this embodiment, the tear strip 84 extends from a first edge 85 of each of the first and second opposite sides 37, 38 to an oppositely disposed second edge 86 of each of the first and second opposite sides 37, 38. In one example, the tear strip 84 is disposed on the flexible bag construction 25 such that the tear strip 84 is adjacent to the top edge 9*a* of the sidewall construction 8 when the package 1 is in the expanded configuration. In another embodiment, the tear strip 84 is disposed on an interior surface of the first and second opposite sides 37, 38 of the flexible bag construction 25.

In one example, a notch 87 (shown in FIG. 7A) is disposed in the flexible bag construction 25 at the first edge 85. The tear strip 84 includes a grip projection 88 that extends into the notch 87. The notch 87 provides a location at which the grip projection 88 of the tear strip 84 to be grasped and pulled to expose the popped popcorn flakes 4.

In one example, the tear strip 84 is made from a high-temperature polyester material having a width in a range of about ⅛ inch to about 1 inch or about ¼ inch to about ¾ inch. In another example, the width of the tear strip 84 is at least ¼ inch.

Figure 6:
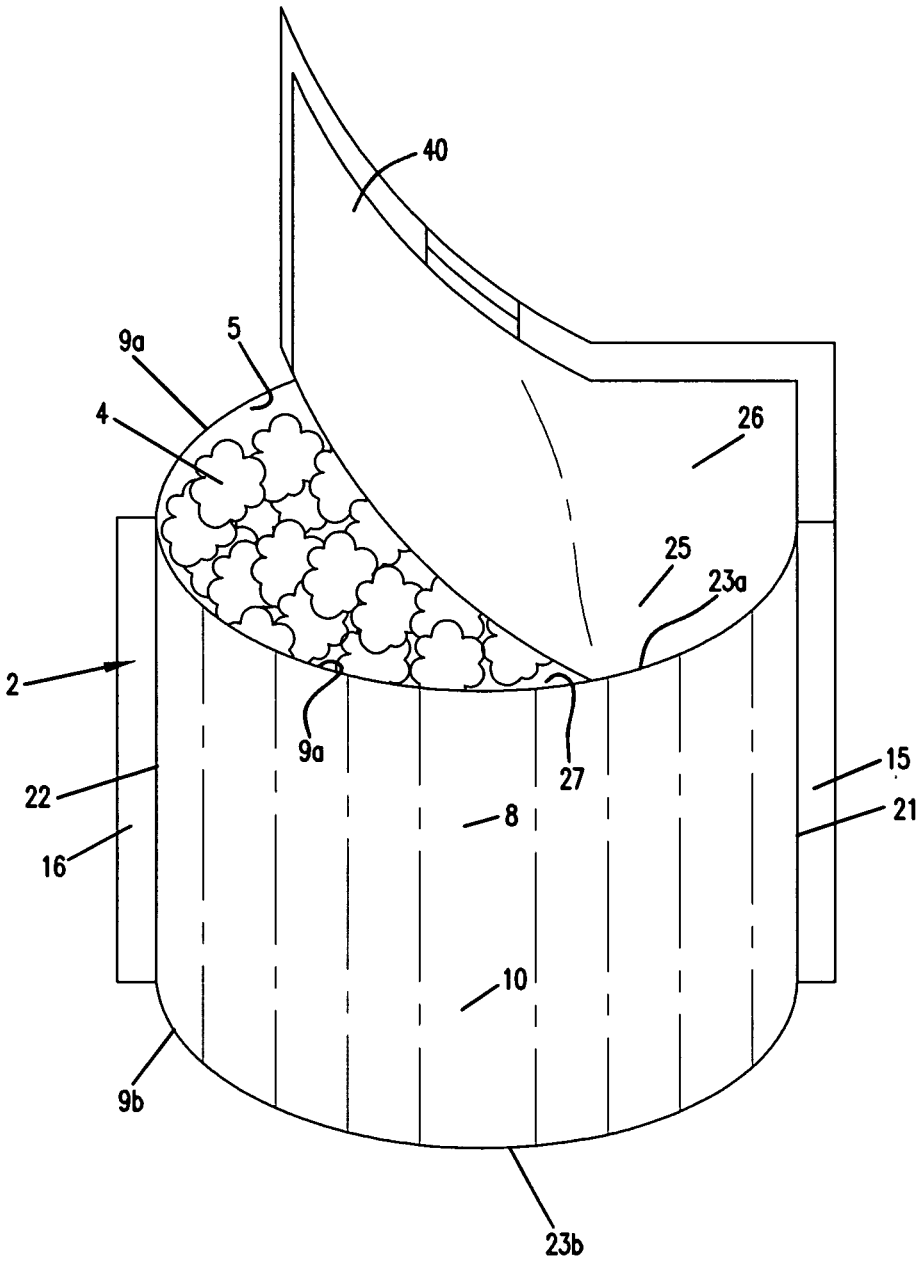
FIG. 6 is a microwave popcorn package according to FIG. 5, depicted during a step of opening.

In FIG. 6, a step of opening the package 1 is shown in which region 40 is being torn from remainder 2 of the package 1 at top edges 9*a* to expose the popped popcorn flakes 4. After the tearing of FIG. 6, the arrangement of FIG. 1 results. The tearing could conveniently have been initiated at tear line 83 (shown in FIG. 5) or by pulling the tear strip 84 (shown in FIG. 5A). In some instances after region 40 is removed, the consumer can increase the curvature to the sidewall construction 8 by pressing the side ends 15 and 16 of the first and second panels 10, 11 of the sidewall construction 8 together.

The package arrangement 1 is utilized to advantage in a variety of ways. The sidewall construction 8 is used to provide side walls for the upstanding bowl 2 that provide for a rigid side wall structure after the popcorn is popped and while it is being consumed. The flexible bag structure 25 is used to facilitate containment, folding and collapsing, for convenient assembly while shipping, storage and use. To facilitate expansion, the first and second panels 10, 11, of the sidewall construction 8 are provided with weakening lines, in this instance score lines 18, 21, 22, to facilitate curved configuration and expansion. A characteristic is that, when expanded, the package 1 has a vertically rigid sidewall; and, a bottom which is part of an internally received flexible bag (and is not rigid).

For the embodiment shown, the first and second panels 10, 11, are joined at side ends or tabs 15, 16, at which, in the preferred embodiment shown, they are joined to one another with portions of the flexible bag construction 25 (in particular portions of side seams) therebetween.

In the next section, the features of the flexible bag construction 25 are examined in detail.

II. The Flexible Bag Construction 25

A variety of constructions can be used to form the flexible bag construction 25. For example, the flexible bag construction 25 can be a single ply arrangement, or a multi-ply arrangement, such as a two-ply arrangement. As previously discussed, the depicted examples in the figures utilize a flexible bag construction 25 which is two-ply. Thus, such an arrangement will be described herein in detail. After description of a convenient two-ply bag, adaptation of the principles to a convenient single ply bag arrangement will be provided.

A typical bag arrangement will comprise structural materials which, in conglomerate, have a weight of no more than 60 lbs. per ream, typically no more than 50 lbs. per ream, and, in part as a result, are quite flexible.

Figure 7:
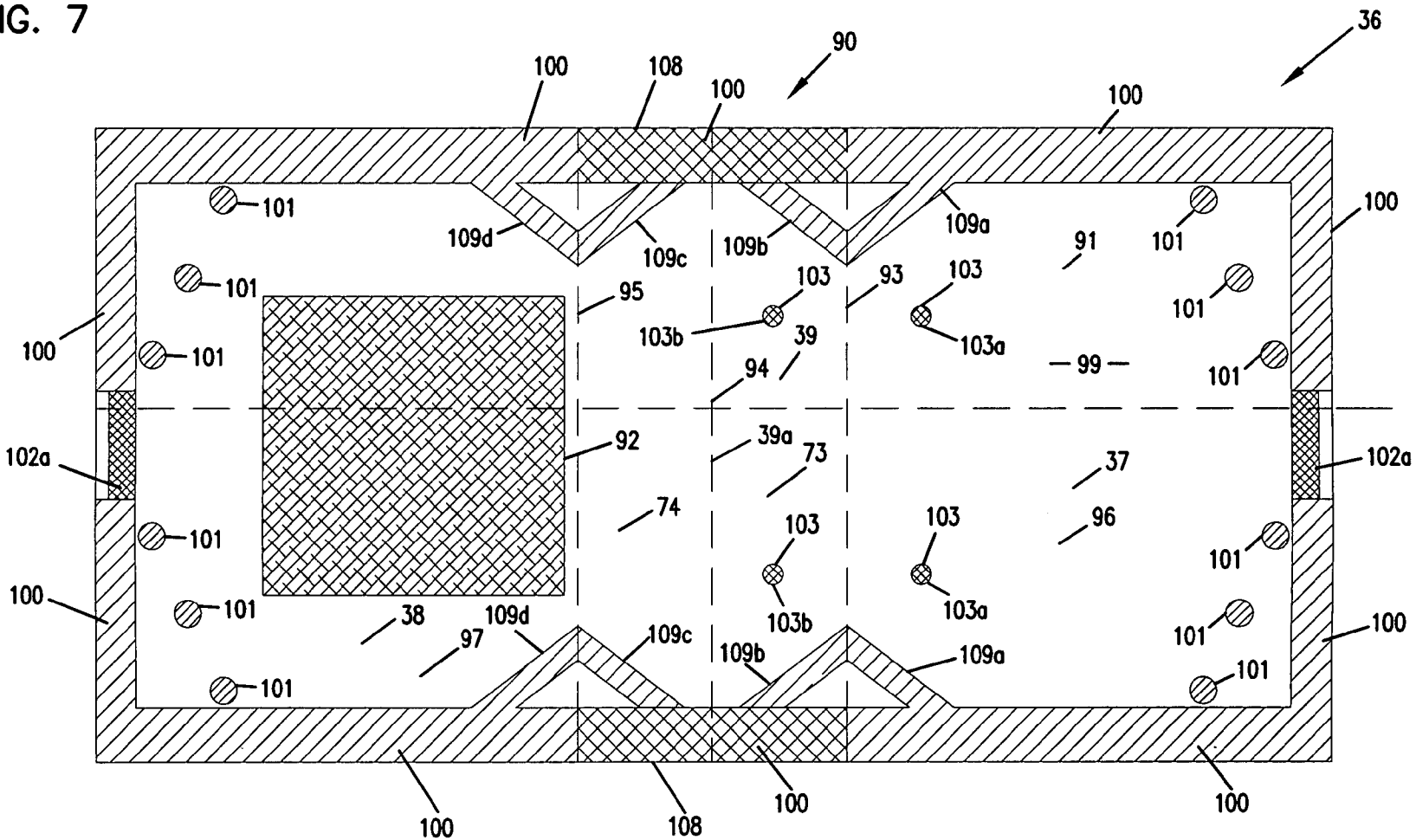
FIG. 7 is a plan view of a flexible blank usable to form an internal bag component of the microwave popcorn package of FIGS. 1-6.

In FIG. 7, a foldable one-piece or single piece bag blank 90 having a two-ply construction 91 with a susceptor 92 positioned between the plies is shown. The particular bag blank 90 depicted is rectangular. Although other shapes can be used, rectangular ones are convenient. In FIG. 7, various notations described below indicate: preferred locations of fold lines; preferred locations of seal or seam material; and, a preferred location between the plies for a susceptor 92. Three folds along lines 93, 94, 95 are used to form bottom or base gusset 39 and side panels 73, 74 (shown in FIG. 4). The resulting preferred bottom gusset would be an internally directed bottom gusset with two side panels. Opposite sides 37, 38 of the flexible bag construction 25 would be formed by regions 96 and 97 respectively. Heat seal material on upper surface 99 in the regions indicated at 100, would be used to seal the two panels to one another along outer edges. Seal dots at 101, provide a diagonal seam and thus a preferred top configuration of the flexible bag construction 25. In region 102 a heat releasable seam between panels 37, 38 at 70*a* (shown in FIG. 5) would be provided.

Spot seals are also indicated at 103. In the completed flexible bag construction 25, adhesive at spot seals 103 would close the gusset 96 against panel 73, to inhibit popcorn from entering this region, during a filling and handling operation. This occurs by spot seals 103*a* being folded, around fold line 93, over and into engagement with spot seals 103*b*.

In region 108, adhesive would also be provided on the back side (i.e., opposite side from the view of FIG. 7) to provide a preferred bottom gusset configuration.

As the gussets are being folded around fold line 93, diagonal seams 109*a* will overlap and seal to diagonal seams 109*b*, and diagonal seams 109*c* will be folded over fold line 95, into engagement with diagonal seams 109*d*. This will also help form a convenient stand-up base gusset 39, in the resulting product.

The resulting side edges of the flexible bag construction 25 formed from folding the blank of FIG. 7 could be positioned between the panels 10, 11 and secured into and along end seams 15, 16.

Figure 7A:
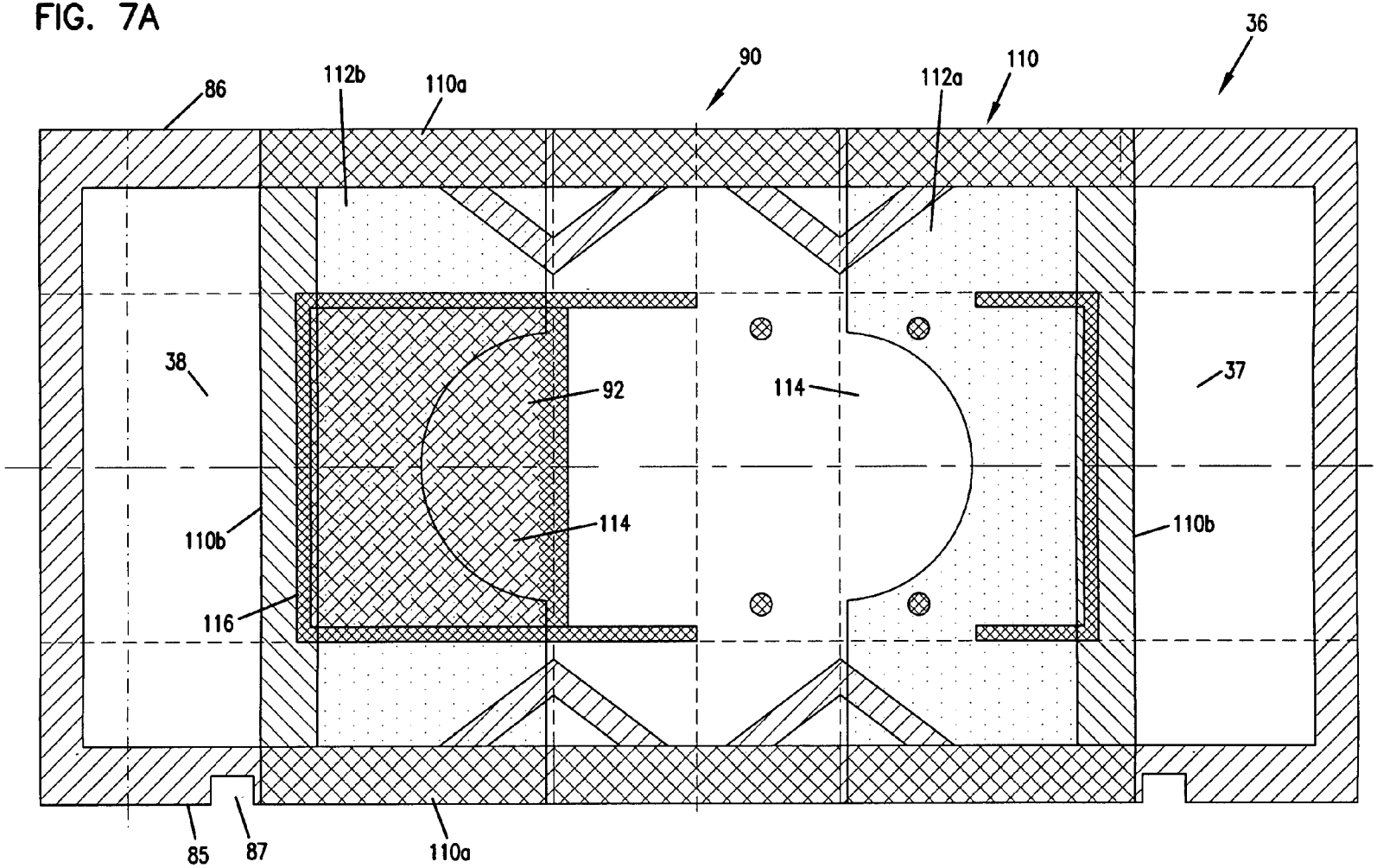
FIG. 7A is a plan view of an alternative flexible blank usable to form an internal bag of the microwave popcorn package of FIGS. 1-6.

In FIG. 7A, the bag blank 90 includes an adhesive region 110 disposed on the backside (i.e., opposite side from the view of FIG. 7A) of the bag blank 90. The adhesive region 110 provides a location at which the flexible bag construction 25 can be secured to the interior of the sidewall construction 8. In the depicted example, the adhesive region 110 includes generally horizontal sections 110*a* that extend along the first and second edges 85, 86 of the flexible bag construction 25 and generally vertical sections 110*b* that extend between the first and second edges 85, 86 such that the adhesive region 110 outlines a generally rectangular shape. In the depicted example, the adhesive region 110 is symmetrically disposed about the center fold line 39*a*.

Within the adhesive region 110 are adhesive areas 112*a*, 112*b* that are disposed on the backsides (i.e., opposite side from the view of FIG. 7A) of the first and second sides 37, 38, respectively. The adhesive areas 112 further secure the first and second sides 37, 38 of the flexible bag construction 25 to the interior of the sidewall construction 8. In the depicted example, each of the adhesive areas 112*a*, 112*b* includes an adhesive-free zone 114. In the depicted example, the adhesive-free zone is generally semi-circular in shape. The adhesive-free zone 114 allows the flexible bag construction 25 to pull away from the sidewall construction 8 which allows for the package 1 to form a bowl-shape configuration in the expanded configuration.

In the depicted example of FIG. 7A, the susceptor 92 is surrounded by a susceptor adhesive overlap region 116. In the depicted example, the susceptor adhesive overlap region 116 has a width greater than the width of the susceptor 92 by at least 0.25 inches and a length greater than the length of the susceptor 92 by at least 0.25 inches. Exemplary adhesive patterning for the susceptor overlap region 116 has been disclosed in U.S. Pat. No. 5,753,895, entitled "Microwave popcorn package with adhesive pattern", filed on Jan. 16, 1996, and hereby incorporated by reference in its entirety.

A preferred sealant for all seals on the blank of FIGS. 7 and 7A, and as a laminating adhesive between the plies, is a polyvinyl acetate adhesive, such as Duracet 12 from Franklin, Intl. of Columbus, Ohio.

Figure 8:
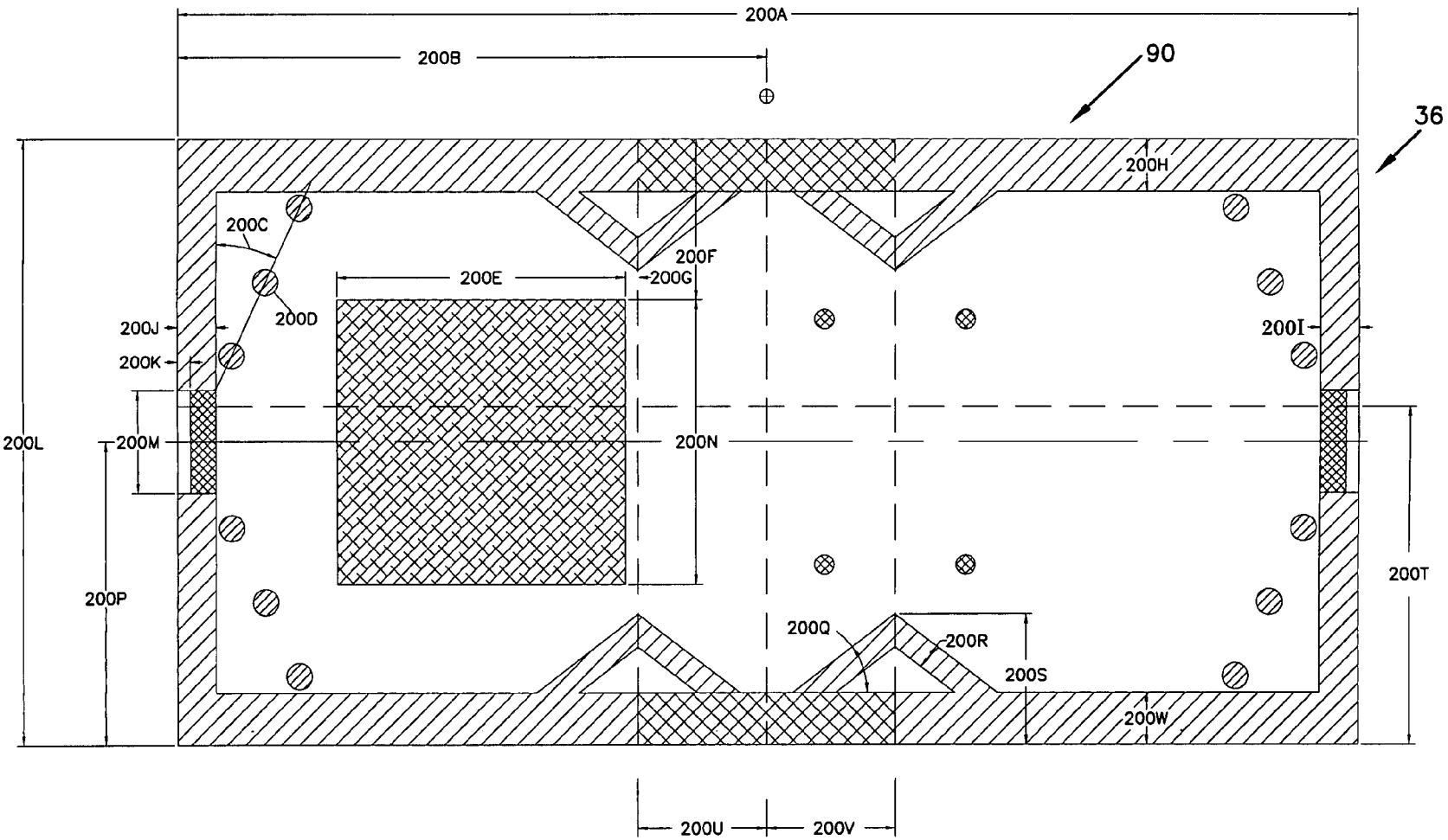
FIG. 8 is a view of FIG. 7, showing exemplary dimensions and angles for a particular embodiment.

In FIG. 8, the exemplary embodiment of FIG. 7 is depicted with various dimensions and angles indicated. The following table provides exemplary values and ranges for those dimensions and angles.

TABLE 1

Dimensions and Angles for FIG. 8

| Dimension/ Angle | Example | Typical[1] | Preferred |
|---|---|---|---|
| 200A | 27 in. (68.6 cm.) | 50-85 cm. | 60-75 cm. |
| 200B | 13.5 in. (34.3 cm.) | 25-42.5 cm. | 30-37.5 cm. |
| 200C | 25° | 17-33° | 22-28° |
| 200D | 0.5 in. (dia) (1.27 cm.) | 0.8-1.8 cm. | 1-1.6 cm. |
| 200E | 5.625 in. (14.29 cm.) | 18-20 cm. | 11-17 cm. |
| 200F | 3.062 in. (7.78 cm.) | 4-12 cm. | 6-9 cm. |
| 200G | 0.125 in. (0.32 cm.) | 0.1-0.8 cm. | 0.2-0.6 cm. |
| 200H | 1 in. (2.54 cm.) | 1.8-4.0 cm. | 1.9-3 cm. |
| 200I | 0.75 in. (1.9 cm.) | 1.7-2.8 cm. | 1.7-2.2 cm. |
| 200J | 0.75 in. (1.9 cm.) | 1.7-2.8 cm. | 1.7-2.2 cm. |
| 200K | 0.25 in. (0.63 cm.) | 0.4-0.7 cm. | 0.5-0.7 cm. |
| 200L | 11.625 in. (29.53 cm.) | 25-40 cm. | 25-35 cm. |
| 200M | 2 in. (5 cm.) | 3-8 cm. | 3.8-6.35 cm. |
| 200N | 5.5 in. (14 cm.) | 8-20 cm. | 11-17 cm. |
| 200P | 5.81 in. (14.8 cm.) | 10-20 cm. | 12.5-17.5 cm. |
| 200Q | 37° | 30-45° | 33-41° |
| 200R | 0.5 in. (1.27 cm.) | 0.8-2 cm. | 1-1.5 cm. |
| 200S | 2.25 in. (5.72 cm.) | 4.5-7.6 cm. | 5-6 cm. |
| 200T | 6.5 in. (16.5 cm.) | 12-22 cm. | 13-19 cm. |
| 200U | 2.75 in. (6.99 cm.) | 6-8 cm. | 6.5-7.5 cm. |
| 200V | 2.75 in. (6.99 cm.) | 6-8 cm. | 6.5-7.5 cm. |
| 200W | 1 in. (2.54 cm.) | 1.8-4.0 cm. | 1.9-3 cm. |

[1]A wide range, not limited to the values in the table, can be used. In this category typical ranges for arrangements like those depicted are provided.

A variety of alternate bag configurations can be used. For example bags with multiple gussets, bags with top gussets, etc., could be adapted and used in the application shown. A typical preferred bag constructions will be ones which have a bottom gusset that can open, to form a bottom to the upright bowl 2, in use. Other features will be generally those that contain the popcorn well, can be manufactured easily, and which expand in a convenient manner, in use. Also configurations with a portion that can be torn off or open easily and conveniently, will be preferred.

III. Preferred Adhesive Pattern Securing the Flexible Bag Construction 25 to the Sidewall Construction 8

Figure 9:
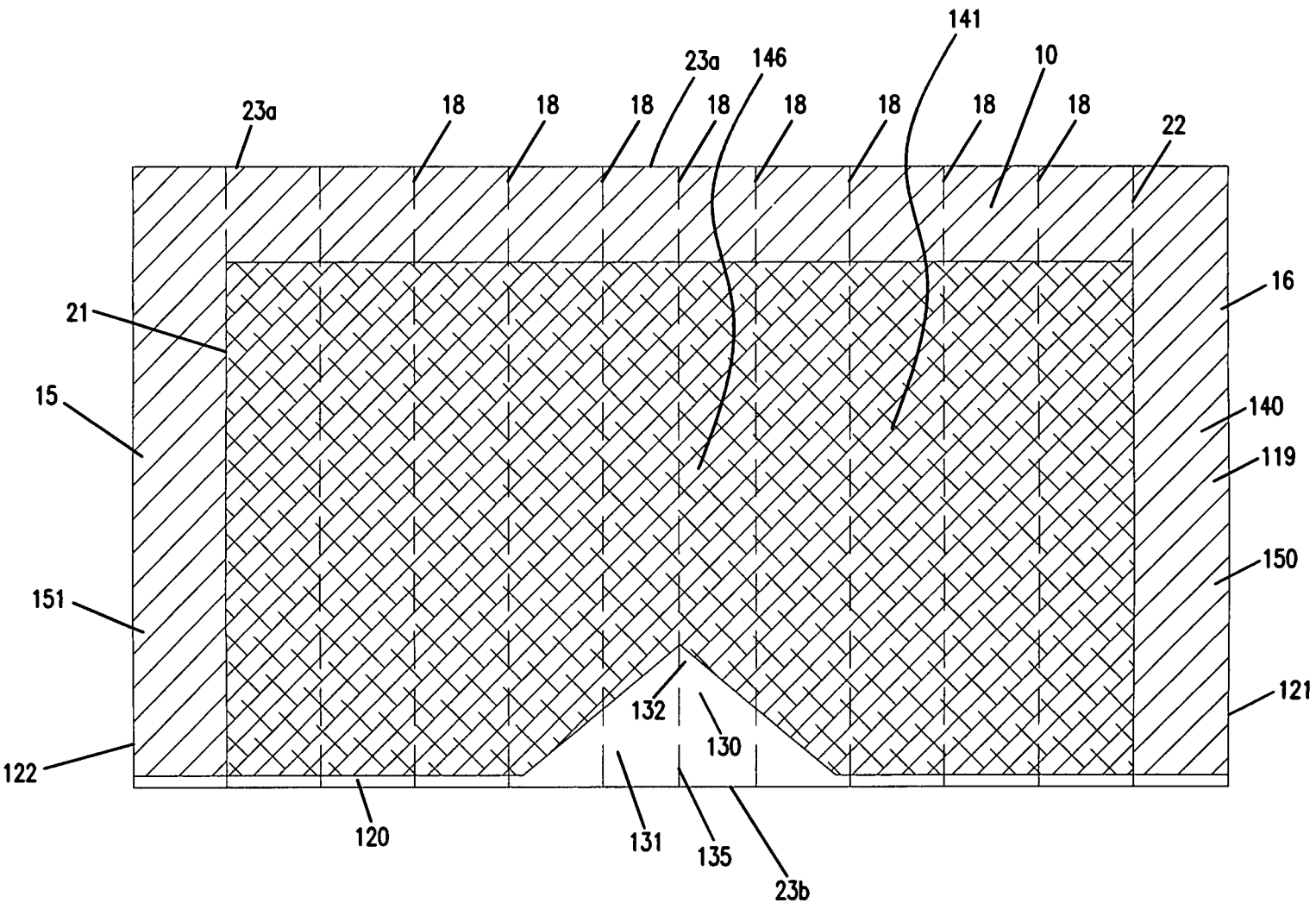
FIG. 9 is a plan view of a side paper board component suitable for use in the microwave popcorn package of FIGS. 1-6.

In FIG. 9, one of the first and second panels 10, 11 is depicted. In particular, the first panel 10 is depicted. It is noted however the first and second panels 10, 11 can be structurally identical to one another, positioned as mirror images.

In FIG. 9, a surface 119 of the first panel 10 is depicted, which will form a surface against the flexible bag construction 25.

In FIG. 9, a preferred adhesive pattern between the flexible bag construction 25 and the first panel 10 is depicted. In particular, no adhesive would be positioned along bottom edge strip 120 between side edges 121, 122. Edge strip 120 will be positioned in package 1 to form the bottom edge 23*b* adjacent bottom gusset 39. Preferably, a no adhesive (adhesive-free) region or strip 120 extends adjacent to and upwardly from bottom edge 23*b*, a distance of about 2 to 6 mm. This region of no adhesive helps allow the flexible bag construction 25 to pull away from the first and second panels 10, 11 immediately adjacent edge 23*b*, so the bottom gusset 39, FIG. 5, can conveniently open and stand up.

In central region 130, adjacent to, and joining, edge strip 120, a second region 131 of no adhesive (or adhesive-free region) is provided. No adhesive in this region allows the flexible bag construction 25 to pull away from the first and second panels 10, 11, in the bottom center, during popping and expansion. This facilitates the package 1 being stood up.

In general, region 130 should be a region containing no adhesive that is located centrally between side ends 121, 122. The region should have a total area of at least 9.5 sq. cm., and typically and preferably an area of 12 to 19 sq. cm. Preferably it extends away from edge 23*b* a distance, at its maximum, of at least 2.5 cm. and typically 3 to 4 cm. Preferably at its widest extension, in the direction along the direction of edge 23*b*, it extends over a distance of at least 6 cm., typically 8.5 to 9.5 cm. Most preferably its widest extension is a bottom region located adjacent edge strip 120, and its narrowest region is an opposite top region 132. A typical preferred configuration is a triangular shape, centered along central line 135 of the first panel 10, with the central line 135 extending generally parallel to opposite edges 121, 122, centrally positioned therebetween. The central line 135 could also be a crease or score line 18. It is noted that although alternate shapes to triangular can be used, the triangular shape provided helps provide for a symmetrical pulling away of gusset 39 from first panel 10 in this region, to create a convenient bottom gusset 39 for the flexible bag construction 25.

In regions 140, 141, adhesive patterns are located. Typically and preferably in region 140, the adhesive coverage is continuous. Thus, preferably along top edge 23*a* a continuous extension of adhesive is provided, as well as along side edges 121, 122. Region 140 preferably extends at least 1.8 cm. typically 2 to 3 cm., inwardly from adjacent ones of edges 121, 122, and 23*a*.

Region 141 generally occupies a central portion 146 of panel 10, except for the region occupied by no adhesive regions 120, 130. It is not necessary that there be a complete adhesive coverage in region 141, although complete adhesive coverage could be used. An adhesive coverage created in a pattern that provides for no more than 60%, and typically for no more than 50%, of adhesive coverage in the region can be used, for example, by providing the adhesive in a dot pattern or in a line pattern, etc. Patterns in accord with those shown as laminating adhesive patterns in U.S. Pat. Nos. 5,753,895; 5,928,554; 5,049,072; and 6,396,036, i.e., as patterns for laminate adhesive between plies, could be adapted. These patents are incorporated herein by reference and the patterns can be used to secure the bag to the sidewall.

Of course the second panel 11 would preferably be configured identically to first panel 10, with respect to shape and adhesive/no adhesive regions. The flexible bag construction 25 would be secured to the adhesive on each panel, between the panels. Side seams on the flexible bag construction 25 would be positioned in overlap with regions 150 and 151 (shown in FIG. 9). It is noted that the adhesive pattern discussed with respect to FIG. 9 could be provided on the outside of the flexible bag construction 25 in addition to, or as an alternative to, being provided on the first and second panels 10, 11.

Figure 10:
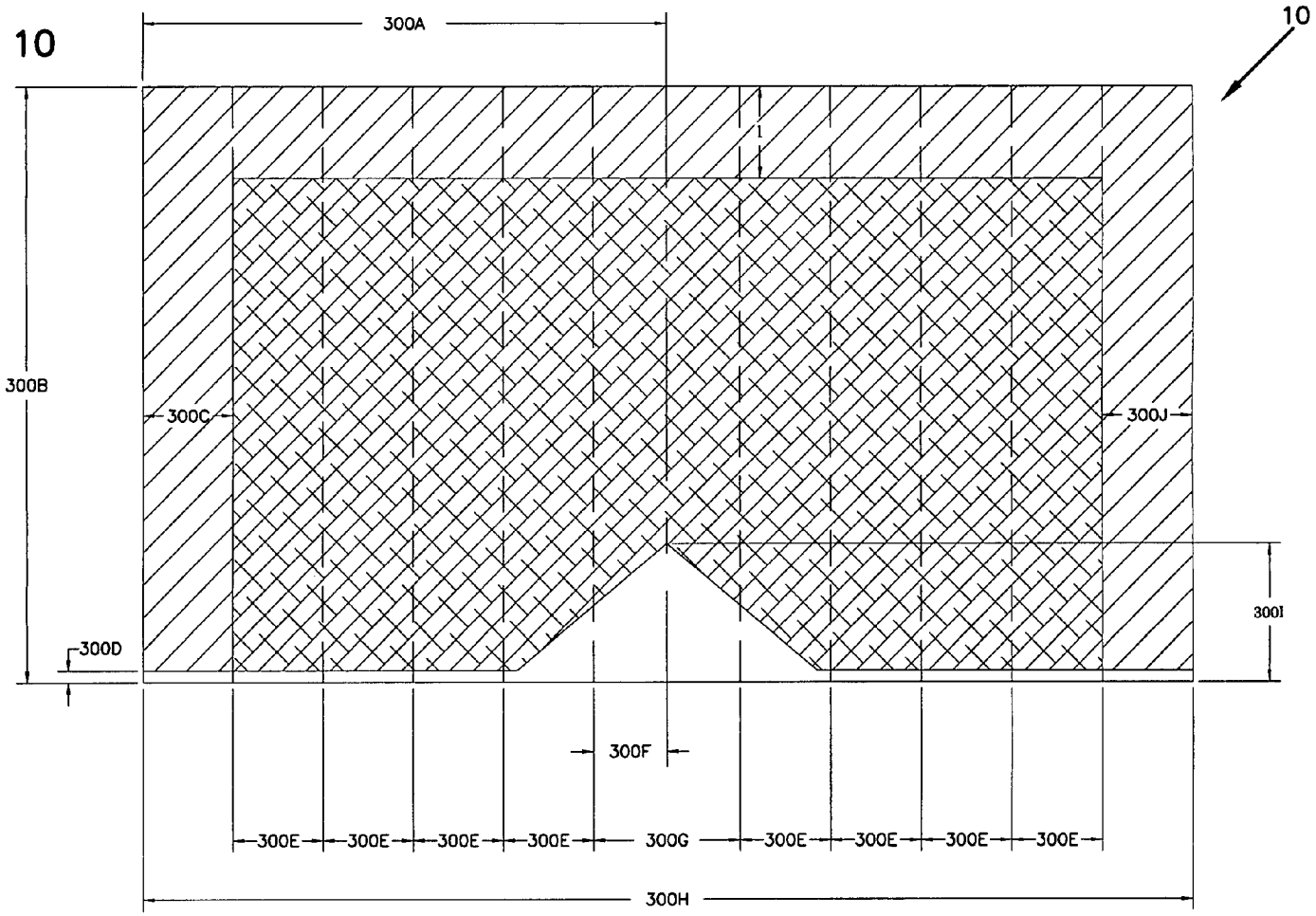
FIG. 10 is a depiction of the panel component of FIG. 9, with some example dimensions provided.

Attention is now directed to FIG. 10. In FIG. 10, the first panel 10 is depicted analogously to FIG. 9. In FIG. 10 various dimensions of an operable example are indicated, by reference to the following table. A perimeter area for the panel would be defined by Dimension 300H by Dimension 300B. A height would be dimension 300B, and a width dimension 300H.

TABLE 2

Dimensions and Angles for FIG. 10

| Dimension/ Angle | Example | Typical[1] | Preferred |
|---|---|---|---|
| 300A | 5.81 in. (14.76 cm.) | 10-20 cm. | 12-18 cm. |
| 300B | 6.5 in. (16.5 cm.) | 10-22 cm. | 13-19 cm. |
| 300C | 1 in. (2.54 cm.) | 1.7-3.5 cm. | 1.9-3 cm. |
| 300D | 0.125 in. (0.32 cm.) | 0.1-0.8 cm. | 0.2-0.6 cm. |
| 300E | 1 in. (2.54 cm.) | 1.5-3.5 cm. | 1.9-3 cm. |
| 300F | 0.81 in. (2.06 cm.) | 1.0-5.0 cm. | 1.5-3 cm. |
| 300G | 1.625 in. (4.13 cm.) | 3-5 cm. | 3.5-4.8 cm. |
| 300H | 11.625 in. (29.5 cm.) | 20-40 cm. | 25-35 cm. |
| 300I | 1.5 in. (3.8 cm.) | 2.5-5 cm. | 3.2-4.6 cm. |
| 300J | 1 in. (2.54 cm.) | 1.8-4.0 cm. | 1.9-3 cm. |

[1]A wide range, not limited to the values in the table, can be used. In this category typical values for arrangements like those depicted are provided.

IV. Materials, Methods of Assembly and Use

A preferred material for the first and second panels 10, 11 would be 10-12 point paperboard, scored or creased with vertically continuous creases spaced about every 19 to 30 mm, thereacross, with the scores or creases being vertically complete. However alternate board materials could be used. A center crease or score, midway between side edges 121, 122, FIG. 9, will be preferred. A preferred crease pattern is indicated in FIG. 10 and Table 2. The dimensions of a preferred adhesive pattern are also provided in FIG. 10 and Table 2.

A variety of fiberboard or paperboards can be used. Standard materials, usable as product carton packages, are convenient and usable. The flexible bag construction 25 preferably comprises inner and outer plies as characterized in the Background, for prior art bags.

A preferred adhesive for use between the first panel 10 (or the second panel 11) and the flexible bag construction 25, is a polyvinyl acetate adhesive, such as Duracet 12, identified above.

A preferred sealant for use on outside surfaces for the bag blank of FIGS. 7 and 8 would be a polyvinyl acetate such as Duracet 12 identified above.

Again, paper materials as defined in the background section above, and used for the identified prior art packages, can be used for the flexible bag construction 25. However alternate flexible materials, including non-paper ones, could also be adapted and used. A single-ply or two-ply arrangement could be used. If two-ply, the two-plies of the bag blank can be laminated (for example) with a polyvinyl acetate adhesive, such as Duracet 12.

If two-ply, the microwave interactive susceptor is preferably between the plies, although alternatives are possible. If single ply, the susceptor may, for example, be on the sidewall construction or be on the bag.

For a package dimension in accord with the components depicted in FIGS. 8 and 10, a popcorn charge of about 20-80 grams of unpopped popcorn, and about 10-40 grams fat/oil would be used. For the particular arrangement shown, a solid fat/oil would be preferred. However, a liquid oil could be contained within a bag or internal pouch in accord with the teachings of U.S. application Ser. No. 10/299,537 filed Nov. 18, 2002. Various other additives such as salt, butter, or flavor, could be used as desired.

The microwave interactive susceptor positioned between the two plies of the flexible bag construction 25 could be in accord with conventional microwave susceptors comprising aluminized polyester. Continuous aluminum coverage or patterned aluminum coverage could be used. For a package arrangement dimension as shown in the Figures, the susceptor would have an outside dimension of about 11-17 cm. by 11-17 cm.

Assembly would generally involve providing the bag blank of FIGS. 7 and 8, and folding it into a bag construction with sealing as indicated. The resulting folded arrangement could then be positioned between two panels 10, 11, adhered where indicated by the sealant fields of FIGS. 9 and 10. The popcorn charge could then be distributed into the flexible bag construction 25 into the region adjacent the susceptor 45. Distribution of the popcorn charge in to the region 160, FIG. 3, would be inhibited due to the seals 103, FIG. 7.

The filter arrangement could then be sealed along edge 60, FIG. 5. Region 40 could be folded over panel 10 along fold line 70. The resulting construction could be sealed within a moisture protective outer barrier, for storage and shipping and display.

In use, the package would be removed from the moisture barrier outer wrap, region 40 would be allowed to unfold or partially unfold, and the package would be laid in a microwave oven, with second panel 11 down. A typical construction will yield full popping within a period of about 2 to 5 minutes, in a typical household microwave oven, on high setting.

After popping, the arrangement could be positioned as shown in FIG. 5, and region 40 could then be torn for a remainder 2, to yield bowl construction 2, FIG. 1.

V. Selected Alternatives Utilizing a Different Bag

It has been noted that a single-ply bag can be used for the flexible bag construction 25. In such a system, susceptor 45 could be mounted either on an inside surface of the second panel 11, or as a patch on an outside surface of the single ply bag. In the alternative it could be applied as a patch to the inside surface of the flexible bag construction 25, but such would not be preferred. The single ply bag could be folded from a bag blank having a sealant or adhesive pattern thereon analogous to the pattern shown in FIG. 7, if desired.

If a single ply construction is used, it will be preferred to utilize as the material for the single ply of the flexible bag construction 25, a material which is generally acceptably leak proof to passage of oil therethrough. Treated paper could be used, if desired.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microwave package comprising:

a sidewall construction defining an interior, the sidewall construction including a first side panel having a base end portion and a second side panel having a base end portion, the base end portions of the first side panel and the second side panel forming an opening at a base of the microwave popcorn package, the sidewall construction being selectively expandable between a collapsed configuration and an expanded configuration, wherein the sidewall construction is a vertically rigid material; and a flexible bag construction having a base enclosing the opening formed by the base end portions of the first side panel and second side panel, a portion of the flexible bag construction being secured to the interior of the sidewall construction, the flexible bag construction being selectively expandable between the collapsed configuration and the expanded configuration, wherein the flexible bag construction and the sidewall construction form a container having vertically rigid sidewalls in the expanded configuration.

2. A microwave package as claimed in claim 1, wherein the base is a bottom gusset.

3. A microwave package as claimed in claim 2, wherein the bottom gusset is directed inwardly between a first side and a second side of the flexible bag construction in the collapsed configuration.

4. A microwave package as claimed in claim 1, wherein the sidewall construction defines a ring configuration.

5. A microwave package as claimed in claim 1, wherein the sidewall construction includes a plurality of creases for adaptation from the collapsed configuration to the expanded configuration.

6. A microwave package as claimed in claim 1, wherein the flexible bag construction includes an outward projecting-portion that projects outwardly from the sidewall construction and is adapted to be removed from a remainder of the flexible bag construction.

7. A microwave package as claimed in claim 6, wherein the outward projecting-portion projects outwardly from the sidewall construction in the collapsed configuration.

8. A microwave package as claimed in claim 6, wherein a tear strip that is selectively removable is disposed around the portion of the flexible bag construction that extends outwardly from the sidewall construction.

9. A microwave package as claimed in claim 1, further comprising a microwave interactive construction positioned in thermoconductive relation to the sidewall construction.

10. A microwave package as claimed in claim 9, wherein the flexible bag construction includes an outer ply and an inner ply with the microwave interactive construction positioned between the outer and inner plies.

11. A microwave popcorn package comprising:

a sidewall construction having a first side panel having a base end portion and a second side panel having a base end portion,. the sidewall construction defining an interior between the first and second side panels, the base end portions of the first side panel and the second side panel forming an opening at a base of the microwave popcorn package, the sidewall construction being selectively expandable between a collapsed configuration and an expanded configuration, wherein the sidewall construction is a vertically rigid material that forms vertically rigid sidewalls in the expanded configuration;

a flexible bag construction having a first side, a portion of which is secured to the first side panel of the sidewall construction, a second side, a portion of which is secured to the second side panel of the sidewall construction, and a base extending between the first and second sides of the flexible bag construction, the flexible bag construction being selectively expandable between the collapsed configuration and the expanded configuration, wherein the first side, the second side, and the base of the flexible bag construction define an interior, the base of the flexible bag construction is configured within the opening formed by the base end portions of the first side panel and second side panel; and a popcorn charge disposed in the interior of the flexible bag construction.

* * * * *